US009310750B2

(12) United States Patent
Kikuchi et al.

(10) Patent No.: US 9,310,750 B2
(45) Date of Patent: Apr. 12, 2016

(54) IMAGE FORMING APPARATUS AND PROCESS CARTRIDGE THEREFOR

(71) Applicants: Hisashi Kikuchi, Kanagawa (JP); Takatsugu Fujishiro, Tokyo (JP); Kazuhiko Watanabe, Tokyo (JP); Takaaki Tawada, Kanagawa (JP); Naomi Sugimoto, Kanagwa (JP); Yuu Sakakibara, Kanagawa (JP)

(72) Inventors: Hisashi Kikuchi, Kanagawa (JP); Takatsugu Fujishiro, Tokyo (JP); Kazuhiko Watanabe, Tokyo (JP); Takaaki Tawada, Kanagawa (JP); Naomi Sugimoto, Kanagwa (JP); Yuu Sakakibara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/050,680

(22) Filed: Oct. 10, 2013

(65) Prior Publication Data

US 2014/0119769 A1 May 1, 2014

(30) Foreign Application Priority Data

Oct. 25, 2012 (JP) ..... 2012-235911
Mar. 1, 2013 (JP) ..... 2013-040942

(51) Int. Cl.
*G03G 21/00* (2006.01)
*G03G 15/02* (2006.01)

(52) U.S. Cl.
CPC ..... *G03G 21/0017* (2013.01); *G03G 15/0233* (2013.01)

(58) Field of Classification Search
USPC ..... 399/100
See application file for complete search history.

(56) References Cited

U.S. PATENT DOCUMENTS

| | | | | |
|---|---|---|---|---|
| 5,497,219 | A * | 3/1996 | Kurokawa et al. | 399/176 |
| 6,272,301 | B1 * | 8/2001 | Kawada et al. | 399/148 |
| 6,473,589 | B2 * | 10/2002 | Hisakuni | 399/350 |
| 6,564,034 | B1 * | 5/2003 | Abe | 399/350 |
| 6,701,105 | B2 * | 3/2004 | Funabashi | 399/100 |
| 2003/0039483 | A1 * | 2/2003 | Funabashi | 399/100 |
| 2003/0049555 | A1 * | 3/2003 | Sakon et al. | 430/124 |
| 2004/0063014 | A1 * | 4/2004 | Yoshimura et al. | 430/59.6 |
| 2007/0020005 | A1 * | 1/2007 | Shigezaki et al. | 399/349 |

(Continued)

FOREIGN PATENT DOCUMENTS

| | | | |
|---|---|---|---|
| CN | 1904765 | A | 1/2007 |
| CN | 102298301 | A | 12/2011 |

(Continued)

OTHER PUBLICATIONS

Combined Chinese Office Action and Search Report issued Jul. 3, 2015 in Patent Application No. 201310487461.1 (with English translation of categories of cited documents).

*Primary Examiner* — WB Perkey
*Assistant Examiner* — Linda B Smith
(74) *Attorney, Agent, or Firm* — Oblon, McClelland, Maier & Neustadt, L.L.P.

(57) ABSTRACT

An image forming apparatus includes a rotatable image bearer, a charging member to contact a surface of the image bearer and charge the image bearer, an exposure device to expose the image bearer and form a latent image, a developing device to develop the latent image on the image bearer into a toner image, a transfer device to transfer the toner image from the image bearer onto a transfer medium, and a cleaning blade to contact the surface of the image bearer and remove toner from the image bearer after image transfer. The charging member has surface unevenness created by projections and recesses extending in a direction of rotation of the image bearer. The cleaning blade is configured to abrade projections formed on the surface of the image bearer.

13 Claims, 12 Drawing Sheets

(56) References Cited

U.S. PATENT DOCUMENTS

| | | | | |
|---|---|---|---|---|
| 2007/0146826 | A1* | 6/2007 | Inao et al. | 358/498 |
| 2008/0286672 | A1* | 11/2008 | Fujiwara | 430/66 |
| 2009/0029277 | A1* | 1/2009 | Okuda et al. | 430/96 |
| 2009/0087213 | A1* | 4/2009 | Takaya et al. | 399/100 |
| 2009/0180795 | A1* | 7/2009 | Karasawa et al. | 399/100 |
| 2009/0297206 | A1* | 12/2009 | Fujishiro et al. | 399/100 |
| 2010/0150628 | A1* | 6/2010 | Miki et al. | 399/350 |
| 2011/0229186 | A1 | 9/2011 | Okamoto et al. | |
| 2011/0229188 | A1 | 9/2011 | Watanabe et al. | |
| 2011/0229233 | A1 | 9/2011 | Watanabe et al. | |
| 2011/0318045 | A1* | 12/2011 | Terai et al. | 399/100 |
| 2012/0020700 | A1* | 1/2012 | Yamada et al. | 399/111 |
| 2012/0107565 | A1* | 5/2012 | Kuroda et al. | 428/156 |
| 2012/0301818 | A1* | 11/2012 | Gilmartin et al. | 430/66 |
| 2013/0071163 | A1* | 3/2013 | Watanabe et al. | 399/346 |
| 2013/0091648 | A1* | 4/2013 | Frigo, Jr. | 15/118 |

FOREIGN PATENT DOCUMENTS

| | | | |
|---|---|---|---|
| CN | 101617277 | B | 5/2012 |
| CN | 103124931 | A | 5/2013 |
| JP | 2007-079244 | | 3/2007 |
| JP | 2011-095725 | | 5/2011 |
| JP | 2011-197309 | | 10/2011 |

* cited by examiner

IMAGE FORMING APPARATUS AND PROCESS CARTRIDGE THEREFOR

CROSS-REFERENCE TO RELATED APPLICATIONS

This patent application is based on and claims priority pursuant to 35 U.S.C. §119 to Japanese Patent Application Nos. 2012-235911 filed on Oct. 25, 2012, and 2013-040942 filed on Mar. 1, 2013, in the Japan Patent Office, the entire disclosure of each of which is hereby incorporated by reference herein.

BACKGROUND OF THE INVENTION

1. Technical Field

The present invention generally relates to an image forming apparatus, such as, a copier, a printer, a facsimile machine, a plotter, or a multifunction peripheral (MFP) including at least two of coping, printing, facsimile transmission, plotting, and scanning capabilities, and further to a process cartridge used in the image forming apparatus.

2. Description of the Background Art

There are image forming apparatuses that charge a photoreceptor serving as a an image bearer, expose the photoreceptor, thereby forming an electrostatic latent image, develop the electrostatic latent image with toner into a toner image, and transfer the toner image onto a sheet of recording media. After the toner image is transferred therefrom, the photoreceptor is cleaned as a preparation for subsequent image formation.

For example, to charge the photoreceptor, voltage is applied to a charging device, such as a charging roller including a metal core and a conductive elastic layer overlying the metal core, and the charging roller is disposed in contact with the photoreceptor that rotates. It is preferred that the charging device have stable charging characteristics and be highly resistant to contamination of the photoreceptor with, for example, toner. Further, it is preferred that the charging device do not contaminate the photoreceptor.

For example, JP-2011-095725-A proposes making the surface of the charging roller uneven with projections and recesses extending in the circumferential direction of the charging roller. Specifically, projections having a predetermined width and extending in the circumferential direction are formed in the surface of the charging roller discontinuously, thereby forming recesses, shaped like slots extending in the circumferential direction, between the projections. In such a charging roller, toner can pass through the recesses in the surface, and toner is less likely to be caught on the surface. This configuration can inhibit contamination of the charging roller and secure the charging characteristics for a long time.

To clean the photoreceptor, that is, remove residual toner therefrom, blade cleaning is known. In this method, cleaning blades constructed of an elastic member, such as a rubber plate, are used. In blade cleaning, an edge or ridge of the cleaning blade is pressed against the surface of the photoreceptor that rotates, thereby scraping off from the photoreceptor substances, such as toner, adhering thereto. Blade cleaning is widely used for its simple structure and reliable performance.

SUMMARY OF THE INVENTION

In view of the foregoing, one embodiment of the present invention provides an image forming apparatus that includes a rotatable image bearer, a charging member to contact a surface of the image bearer and charge the image bearer, an exposure device to expose the image bearer and form a latent image, a developing device to develop the latent image on the image bearer into a toner image, a transfer device to transfer the toner image from the image bearer onto a transfer medium, and a cleaning blade to contact the surface of the image bearer and remove toner from the image bearer after image transfer. The charging member has surface unevenness created by projections and recesses extending in a direction of rotation of the image bearer. The cleaning blade is configured to abrade projections formed on the surface of the image bearer.

Another embodiment provides a process cartridge that is removably installable in a body of an image forming apparatus. In the process cartridge, at least the image bearer, the above-described charging member, and the above-described cleaning blade are incorporated, forming a single unit.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
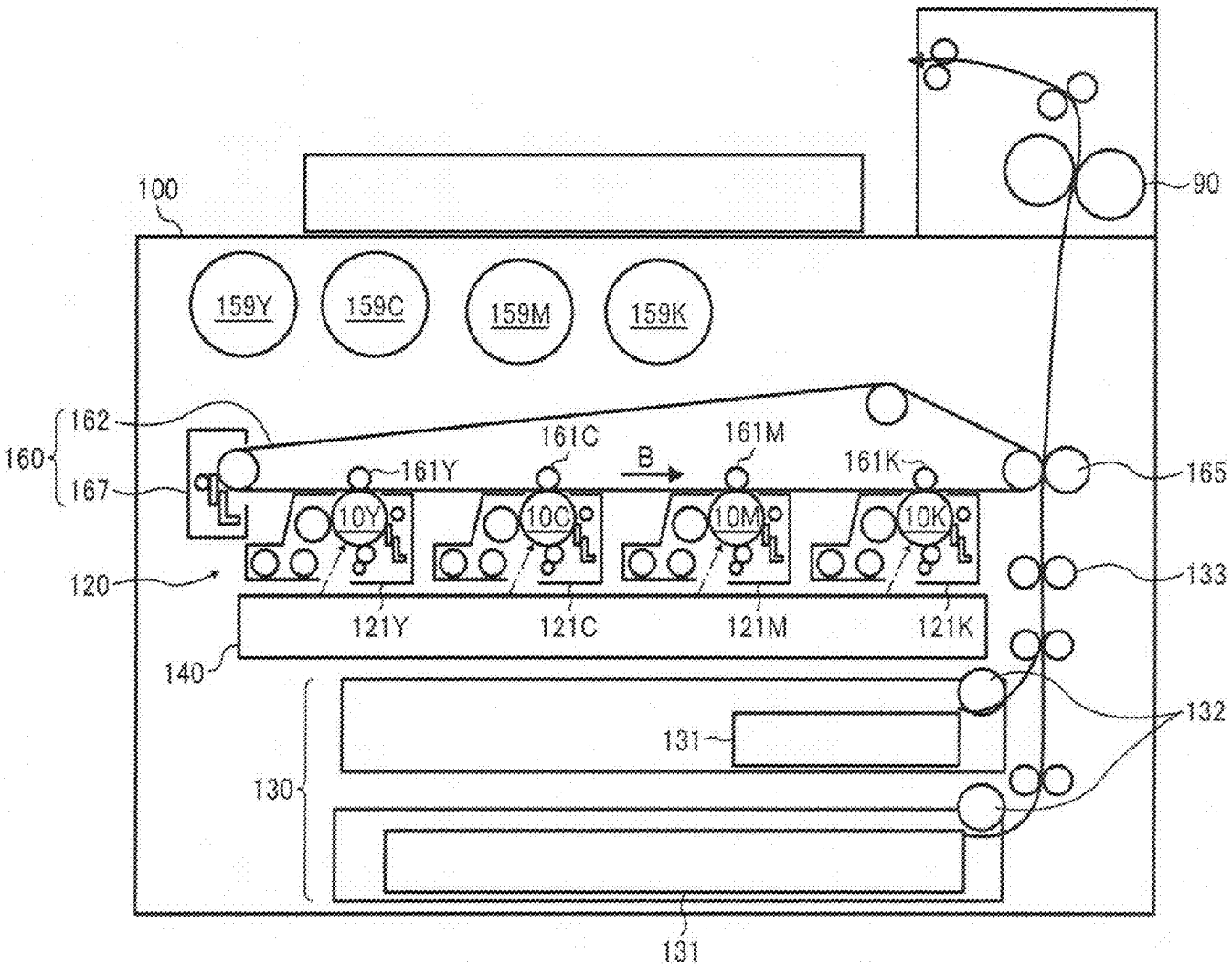
FIG. 1 is a schematic diagram of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

In the embodiments described below, since the surface of a charging member has surface unevenness created by recesses extending in the direction in which an image bearer rotates, toner on the image bearer can pass through the recesses and are not caught on the surface. Therefore, the surface of the charging member can be stain-resistant, and desirable charging capability can be maintained for a long time.

Additionally, when the charging member contacts the image bearer, the surface unevenness of the charging member abrades projections created on the surface of the image bearer, thereby smoothing the surface of the image bearer. Therefore, defective cleaning resulting from the surface unevenness of the image bearer can be inhibited. Then, the cleaning blade can better conform to the surface of the image bearer, and desirable charging capability can be maintained for a long time. Thus, preferable performances of charging and cleaning can be maintained for a long time.

First Embodiment

FIG. 1 is a schematic diagram illustrating an image forming apparatus 100 according to a first embodiment.

The image forming apparatus 100 is a printer, for example. The image forming apparatus 100 is capable of forming multicolor images and includes an image forming unit 120, an intermediate transfer unit 160, and a sheet feeder 130. It is to be noted that reference characters Y, M, C, and K show yellow, magenta, cyan, and black, respectively, and may be omitted in the description below when color discrimination is not necessary.

The image forming unit 120 includes, from the left in FIG. 1, process cartridges 121Y, 121C, 121M, and 121K for yellow, cyan, magenta, and black, respectively. The process cartridges 121Y, 121C, 121M, and 121K are arranged substantially horizontally.

The intermediate transfer unit 160 includes an endless intermediate transfer belt 162, serving as an intermediate transfer member, looped around multiple support rollers, primary-transfer rollers 161Y, 161C, 161M, and 161 K, and a secondary-transfer roller 165. The intermediate transfer belt 162 is positioned above the process cartridges 121 and along the direction in which drum-shaped photoreceptors 10Y, 10C, 10M, and 10K of the respective process cartridges 121 rotate. The intermediate transfer belt 162 rotates in synchronization with the rotation of the photoreceptors 10. The primary-transfer rollers 161 are positioned on the inner circumferential side of the intermediate transfer belt 162. With the primary-transfer rollers 161, the outer circumferential face of a lower portion of the intermediate transfer belt 162 is lightly pressed against the outer circumferential face of the photoreceptors 10.

The process cartridges 121 have a similar configuration and perform similar operation to form toner images on the respective photoreceptors 10 and transfer the toner images onto the intermediate transfer belt 162. However, a shift mechanism is provided for the three primary-transfer rollers 161Y, 161C, and 161M corresponding to the process cartridges 121Y, 121C, and 121 M for colors other than black to move these primary-transfer rollers 161 vertically. The shift mechanism disengages the intermediate transfer belt 162 from the photoreceptors 10Y, 10C, and 10M when multicolor image formation is not performed.

The intermediate transfer unit 160 is removably installable in a body of the image forming apparatus 100. More specifically, a front cover, on the front side of the paper on which FIG. 1 is drawn, covering the image forming unit 120 of the image forming apparatus 100 is opened, and the intermediate transfer unit 160 is slid out from the back side of the paper on which FIG. 1 is drawn to the front side of the paper. Thus, the intermediate transfer unit 160 can be removed from the body of the image forming apparatus 100 (hereinafter also simply "apparatus body"). The intermediate transfer unit 160 can be installed into the apparatus body in the procedure reverse to the installation thereof.

Additionally, a belt cleaning device 167 is disposed downstream from the secondary-transfer roller 165 and upstream from the process cartridge 121Y in the direction indicated by arrow B shown in FIG. 1, in which the intermediate transfer belt 162 rotates. The belt cleaning device 167 removes toner remaining on the intermediate transfer belt 162 after secondary-image transfer. The belt cleaning device 167 and the intermediate transfer belt 162 are supported by a common support and together form the intermediate transfer unit 160 removably installable in the apparatus body.

Above the intermediate transfer unit 160, toner cartridges 159 for the respective process cartridges 121 are arranged substantially horizontally.

Beneath the process cartridges 121, an exposure device 140 is provided. The exposure device 140 directs laser beams to the charged surfaces of the photoreceptors 10 to form electrostatic latent images thereon.

Additionally, the sheet feeder 130 is provided beneath the exposure device 140. The sheet feeder 130 includes sheet trays 131 for containing sheets of recording media and feed rollers 132. The sheet feeder 130 feeds sheets to a secondary-transfer nip formed between the intermediate transfer belt 162 and the secondary-transfer roller 165 via a pair of registration rollers 133 at a predetermined timing.

A fixing device 90 is provided downstream from the secondary-transfer nip in the direction in which sheets are transported (hereinafter "sheet conveyance direction"). Further, a discharge roller and a discharged sheet tray to receive sheets discharged are disposed downstream from the fixing device 90 in the sheet conveyance direction.

Figure 2:
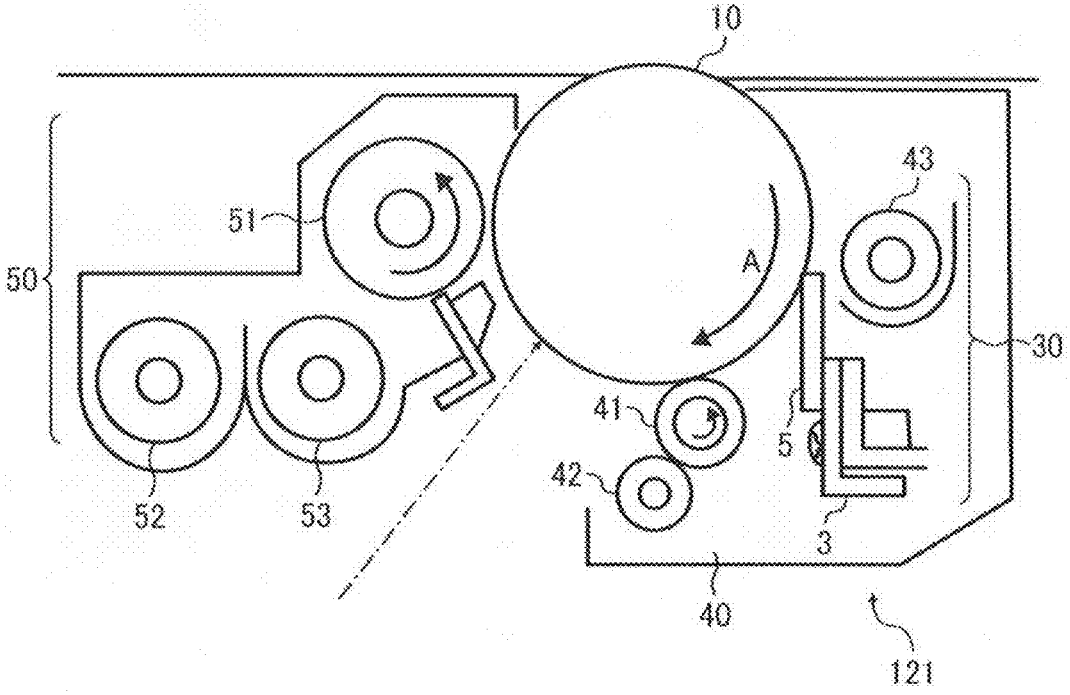
FIG. 2 is an end-on axial view of an image forming unit included in the image forming apparatus shown in FIG. 1.

FIG. 2 schematically illustrates the process cartridge 121 included in the image forming apparatus 100. The process cartridges 121 have a similar configuration, and therefore the subscripts Y, C, M, and K for color discrimination are omitted in the description of the configuration and operation of the process cartridges 121, given below. In addition to the photoreceptor 10, the process cartridge 121 includes a cleaning device 30, a charging device 40, and a developing device 50 disposed around the photoreceptor 10; and supports these components as a single unit.

The cleaning device 30 includes an elastic cleaning blade 5 that is long in the axial direction of the photoreceptor 10 and a discharge screw 43. An edge of the cleaning blade 5 on a long side thereof is pressed against the surface of the photoreceptor 10 to remove substances such as residual toner adhering to the surface of the photoreceptor 10. The discharge screw 43 discharges the removed toner outside cleaning device 30.

The charging device 40 includes a charging roller 41 disposed in contact with the photoreceptor 10 and a charging roller cleaner 42 that rotates while being contact with the charging roller 41.

The developing device 50 is designed to supply toner to the surface of the photoreceptor 10 to develop the latent image formed thereon and includes a developing roller 51 serving as a developer bearer. The developing device 50 includes the developing roller 51, an agitation screw 52, and a supply screw 53. The agitation screw 52 agitates and transports developer contained in a developer container, and the supply screw 53 transports the developer while supplying the agitated developer to the developing roller 51.

The four process cartridges 121 having the above-described configuration can be independently removed from the apparatus body, installed therein, and replaced by service persons or users. Thus, the photoreceptor 10, the charging device 40, the developing device 50, and the cleaning device 30 are incorporated into the process cartridge 121 and can be removed from the apparatus body, installed therein, and replaced together at a time. This configuration can facilitate installation and maintenance work. Further, the incorporating can improve the positional accuracy of the charging device 40, the developing device 50, and the cleaning device 30 relative to the photoreceptor 10.

When the process cartridge 121 is removed from the image forming apparatus 100, the photoreceptor 10, the charging device 40, the developing device 50, and the cleaning device 30 can be replaced independently. It is to be noted that the process cartridge 121 may further includes a waste-toner tank to collect the toner removed by the cleaning device 30. In this case, it is convenient when the waste-toner tank is independently removable, installable, and replaceable.

Next, image forming operation is described below.

When the image forming apparatus 100 receives print commands via a control panel or from external devices such as computers, initially the photoreceptor 10 starts rotating in the direction indicated by arrow A shown in FIG. 2. Then, the charging roller 41 of the charging device 40 charges the surface of the photoreceptor 10 to a predetermined polarity. The exposure device 140 directs light, such as laser beams, for respective colors to the charged photoreceptors 10. The laser beams are optically modulated according to multicolor image data input to the image forming apparatus 100. Thus, electrostatic latent images for respective colors are formed on the photoreceptors 10. The developing rollers 51 of developing devices 50 supply respective color toners to the electrostatic latent images, thereby developing the electrostatic latent images into toner images.

Subsequently, a transfer voltage in the polarity opposite to that of toner images is applied to the primary-transfer rollers 161. Thus, primary-transfer electrical fields are generated between the photoreceptors 10 and the primary-transfer rollers 161 via the intermediate transfer belt 162. The primary-transfer rollers 161 are lightly pressed against the intermediate transfer belt 162, forming primary-transfer nips. With these actions, the toner images are primarily transferred from the respective photoreceptors 10 onto the intermediate transfer belt 162 efficiently. The respective single color toners are superimposed one on another on the intermediate transfer belt 162, forming a multilayer toner image (i.e., multicolor toner image).

Toward the multilayer toner image formed on the intermediate transfer belt 162, a sheet is timely transported from the sheet tray 131 via the feed roller 132 and the pair of registration rollers 133. A transfer voltage in the polarity opposite that of toner images is given to the secondary-transfer roller 165, thereby forming a secondary-transfer electrical field between the intermediate transfer belt 162 and the secondary-transfer roller 165 via the sheet. The toner image is transferred onto the sheet by the secondary-transfer electrical field.

The sheet is then transported to the fixing device 90, in which the toner image is fixed on the sheet with heat and pressure. The sheet bearing the fixed toner image is discharged by the discharge roller to the discharged sheet tray. After the primary-image transfer, toner remaining on the respective photoreceptors 10 is removed by the cleaning blades 5 of the cleaning devices 30.

Next, the charging device 40 and the cleaning device 30 are described in further detail below.

Figure 3:
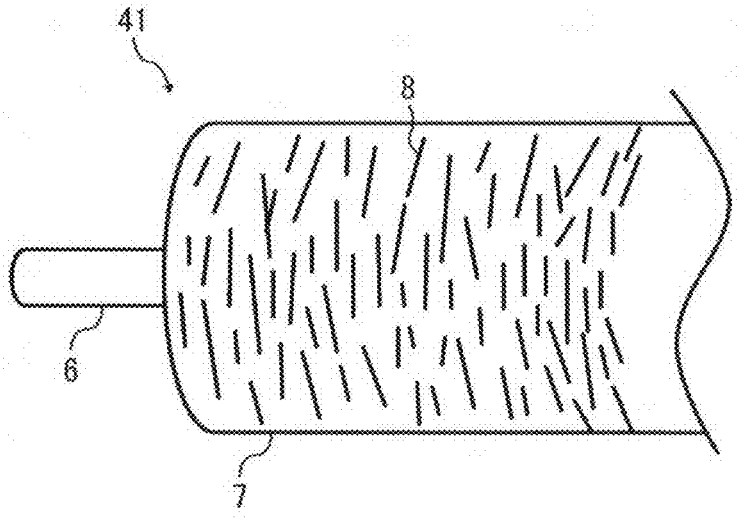
FIG. 3 is a schematic view of a charging roller according to a first embodiment.

FIG. 3 is a schematic view of the charging roller 41 of the charging device 40 according to the first embodiment.

As shown in FIG. 3, the charging roller 41 serving as a charging member includes a metal core 6 and a conductive rubber layer 7 overlying the metal core 6. The surface of the conductive rubber layer 7 includes surface unevenness 8 created by micro recesses (or projections) extending in the circumferential direction, that is, in the direction in which the photoreceptor 10 (image bearer) rotates. The surface unevenness 8 can be created by disposing grinding paper to contact the charging roller 41 while the charging roller 41 is rotating.

With the surface unevenness 8, the surface area of the charging roller 41 that contacts the photoreceptor 10 can be reduced, and contact areas and gap areas can be reasonably distributed. Accordingly, the chance of discharging can increase, making the charging performance stable. The charge stabilizing effect can be high particularly when the process linear velocity is high. Additionally, contamination of the photoreceptor 10 by the charging roller 41 can be inhibited since the contact area is smaller. Additionally, the surface roughness Rz of the surface unevenness 8 in the axial direction is preferably within a range from 2 μm to 20 μM.

The present embodiment employs direct-current (DC) charging in which only DC voltage is applied to the charging roller 41. Compared with alternating-current (AC) charging in which alternating voltage is superimposed on DC voltage, DC charging is advantageous in that load to the photoreceptor 10 can be reduced, and the amount of wear of the photoreceptor 10 can be reduced, thus extending the operational life thereof. In configurations in which the process linear velocity is higher in DC charging, however, if the surface roughness Rz is extremely high, fluctuations in charge potential increase, resulting in image density unevenness. Therefore, the surface roughness Rz is more preferably within a range from 2 μm to 10 μm.

The surface unevenness 8 can be created in the surface of the charging roller 41, by forming projections that are long in the circumferential direction and have a predetermined width discontinuously, thereby forming recesses that are long in the circumferential direction and have a predetermined width. That is, the surface unevenness 8 includes slot-like recesses formed between the projections spaced at intervals and extending in the circumferential direction. With this configuration, toner can pass through the slot-like recesses formed in the surface of the charging roller 41 and be less likely to be caught on the surface. This configuration can inhibit contamination of the charging roller 41 and secure the charging characteristics for a long time.

Figure 4:
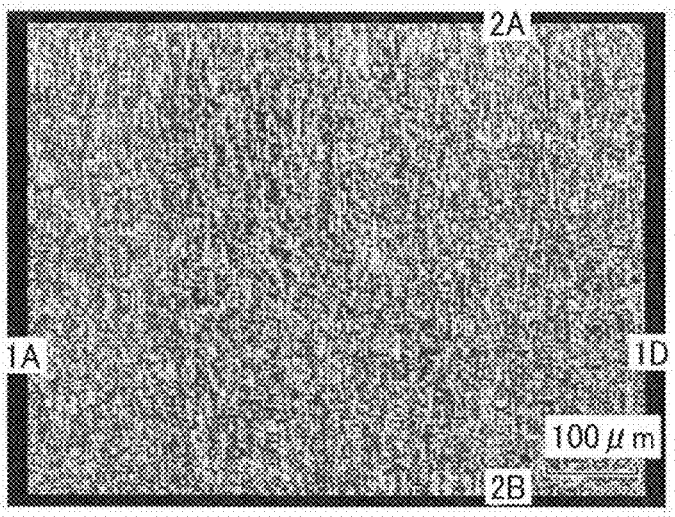
FIG. 4 is a photograph of a surface configuration of the charging roller according to the first embodiment, observed by a laser microscope.
Figure 5A:
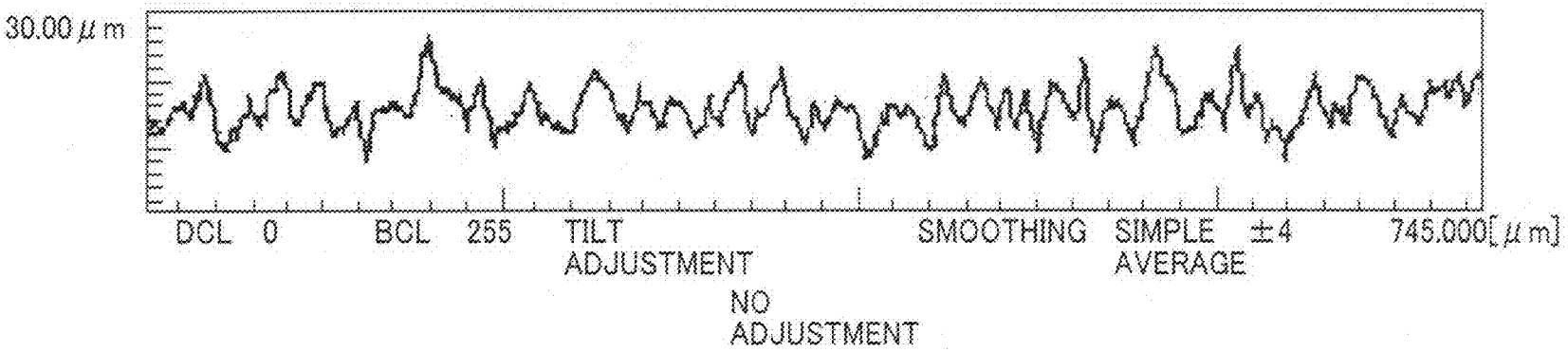
FIG. 5A is a surface roughness profile in an axial direction of the charging roller according to a first embodiment.
Figure 5B:
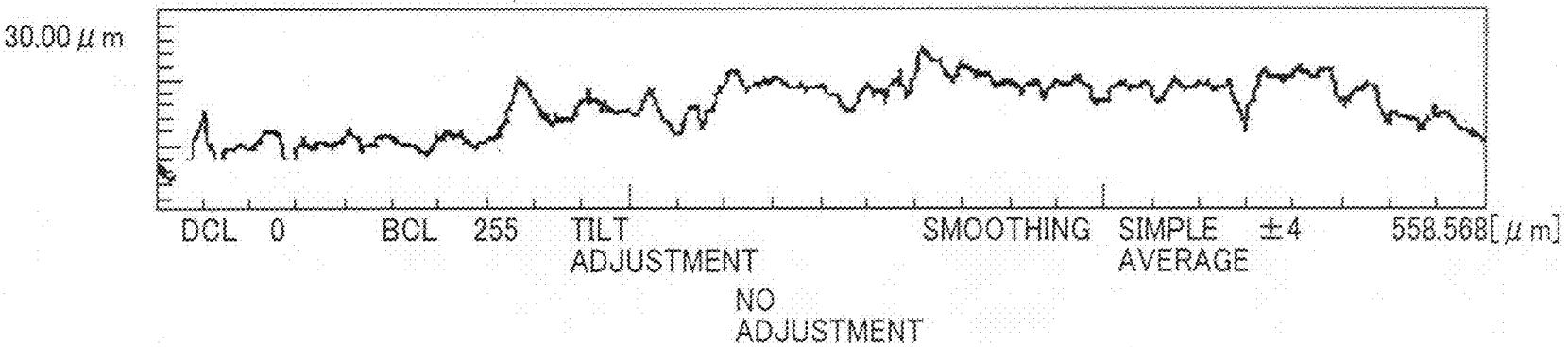
FIG. 5B is a surface roughness profile in a circumferential direction of the charging roller according to the first embodiment.
Figure 6:
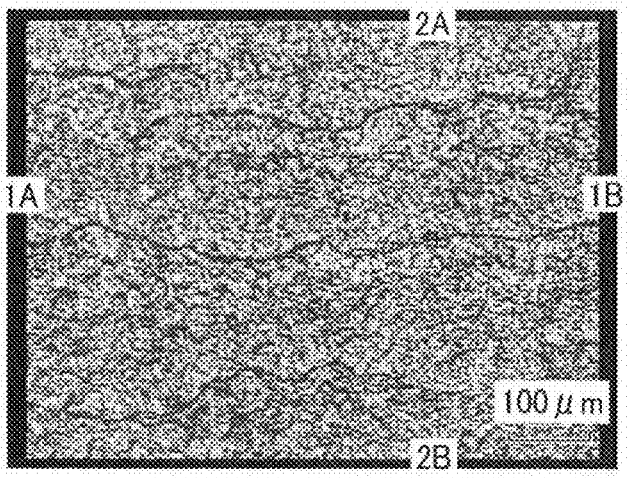
FIG. 6 is a photograph of a surface configuration of a comparative charging roller observed by a laser microscope.
Figure 7A:
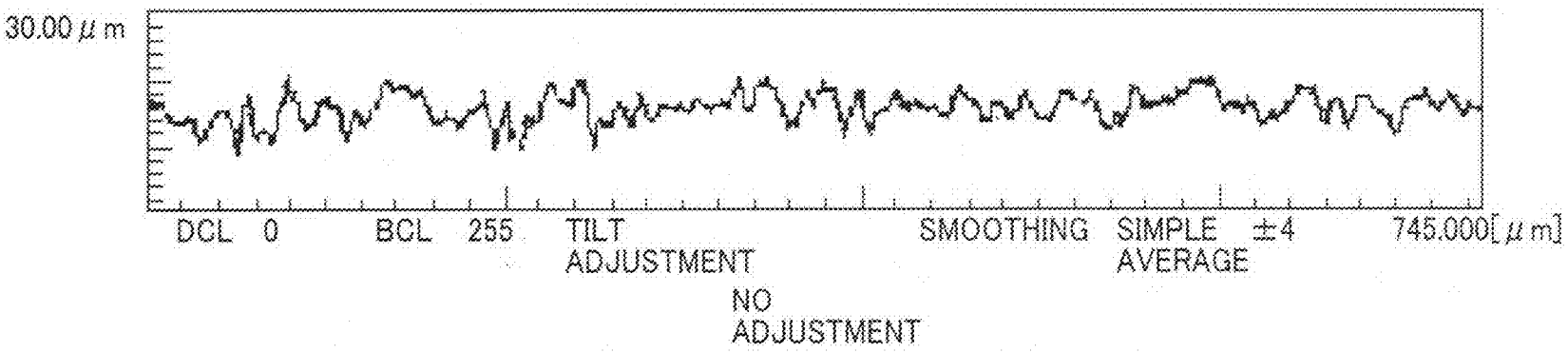
FIG. 7A is a surface roughness profile in an axial direction of the comparative charging roller.
Figure 7B:
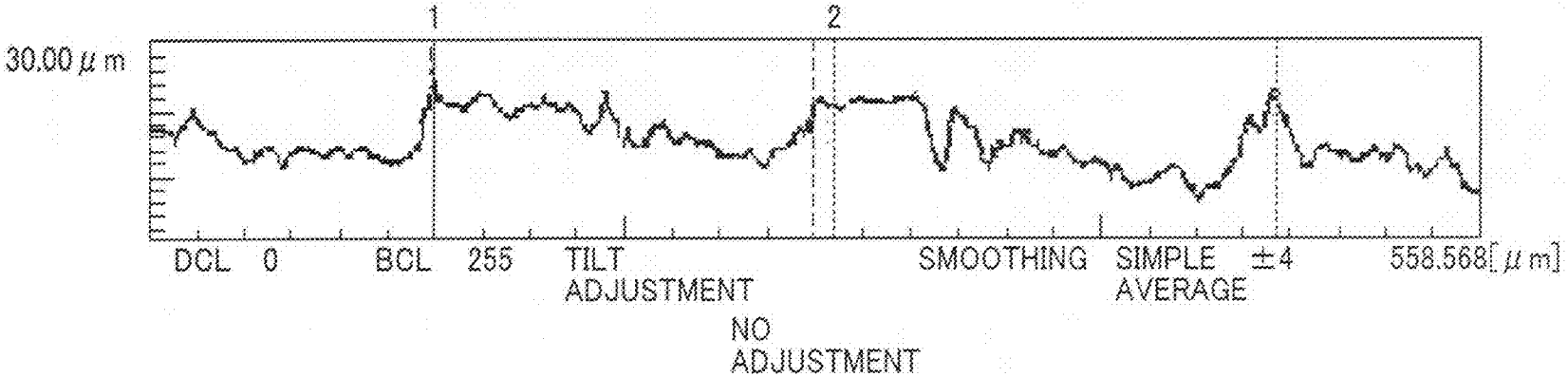
FIG. 7B is a surface roughness profile in a circumferential direction of the comparative charging roller.

FIGS. 4, 5A, and 5B illustrate an example of results when the surface of the charging roller 41 having the surface unevenness extending in the circumferential direction is measured by a laser microscope, VK-8500. FIG. 4 is a photograph of the surface configuration. FIG. 5A is a surface roughness profile in the axial direction, and FIG. 5B is a surface roughness profile in the circumferential direction. Additionally, as a comparative example, a surface of a charging roller having micro unevenness extending in the axial direction was measured similarly, and FIGS. 6, 7A, and 7B illustrate an example of the measuring result. FIG. 6 is a photograph of the surface configuration. FIG. 7A is a surface roughness profile in the axial direction, and FIG. 7B is a surface roughness profile in the circumferential direction.

For example, a SYNZTEC product, CW131, vertical (or lengthwise), can be used as the charging roller 41 having minute projections and recesses extending in the circumferential direction. Additionally, the charging roller having minute projections and recesses extending in the axial direction can be, for example, a SYNZTEC product, CW131, sideways. Compared with the comparative charging roller shown in FIGS. 6, 7A, and 7B, having minute projections and recesses extending axially or sideways in the surface (i.e., axial surface unevenness), the charging roller 41 shown in FIGS. 4, 5A, and 5B, having minute projections and recesses extending in the circumferential direction or lengthwise in the surface (i.e., circumferential surface unevenness) is advantageous in inhibiting contamination of the photoreceptor 10 and that of the charging roller 41.

However, when the charging roller 41 having circumferential surface unevenness is used, the projections and the recesses make the contact state uneven, and the surface of the photoreceptor 10 gradually becomes uneven and abraded. When the height and projections (i.e., the depth of recesses) in the surface of the photoreceptor 10 increases, an edge of a typical blade fails to conform to the surface configuration of the photoreceptor 10. In the recesses of the photoreceptor 10, toner can easily enter gaps between the blade and the photoreceptor 10. When the toner going under the cleaning blade 5 passes though the gap, cleaning becomes defective.

To inhibit defective cleaning, the pressing force (i.e., linear pressure) of the cleaning blade pressing against the photoreceptor may be increased, thereby preventing toner from going under the cleaning blade. Increases in the pressing force, however, can increase the load, and the photoreceptor or the cleaning blade wears. Then, the operational life thereof may be shortened extremely. Sacrificing the durability is not desirable for attaining a long operational life of the apparatus.

In view of the foregoing, the present embodiment can provide an image forming apparatus and a process cartridge capable of maintaining preferable performances of charging and cleaning for a long time.

Figure 8:
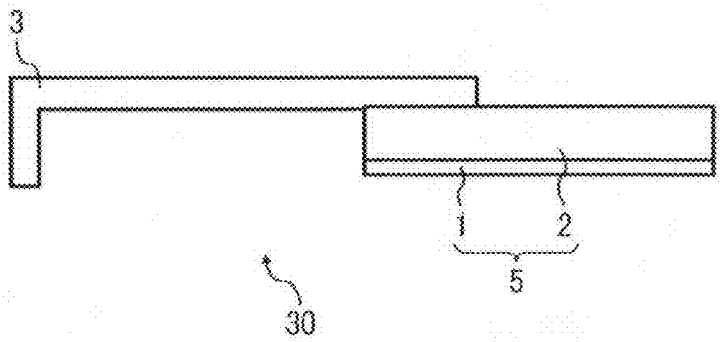
FIG. 8 is an illustration of the cleaning blade according to the first embodiment.

FIG. 8 is an illustration of the cleaning blade 5 according to the first embodiment. The cleaning device 30 further includes a blade holder 3 to support an end of the cleaning blade 5, and the cleaning blade 5 is constructed of a multilayer elastic member. The cleaning blade 5 includes an edge layer 1 and a backup layer 2 constructed of materials different in 100% modulus value from each other. The edge layer 1 is disposed to abut against the photoreceptor 10, and the backup layer 2 is on the back side of the edge layer 1. That is, the cleaning blade 5 shown in FIG. 8 is a bilayer blade constructed of two layers different in 100% modulus value from each other, namely, the edge layer 1 and the backup layer 2.

In the cleaning device 30, the edge of the cleaning blade 5 opposite its end supported by the blade holder 3 is disposed in contact with the surface of the photoreceptor 10 that rotates in the direction A shown in FIG. 2, thereby removing substances such as toner adhering to the photoreceptor 10. Additionally, when the surface unevenness of the charging roller 41 makes micro surface unevenness in the surface of the photoreceptor 10, the cleaning device 30 can abrade the projections, making the surface of the photoreceptor 10 smooth. Next, materials of the cleaning blade 5 are described in further detail below.

Figure 9:
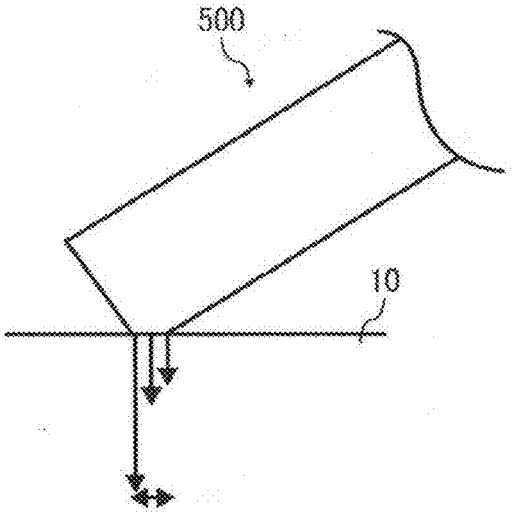
FIG. 9 is a cross-sectional view illustrating a contact portion between a photoreceptor and a cleaning blade having a greater 100% modulus.

FIG. 9 is a cross-sectional view illustrating a contact portion between the photoreceptor 10 and a cleaning blade 500 made of a material having a greater 100% modulus value. Use of the material whose hardness and 100% modulus are high can inhibit an unnecessary increase in the width of the contact nip between the cleaning blade 500 and the photoreceptor 10. This configuration can attain high peak pressure required for blocking small toner particles having a higher circularity, which are currently increasingly used. Additionally, when minute projections are formed on the surface of the photoreceptor 10 corresponding to the surface unevenness of the charging roller 41, such a material can attain high peak pressure required to abrade the projections, making the surface smooth.

Figure 10:
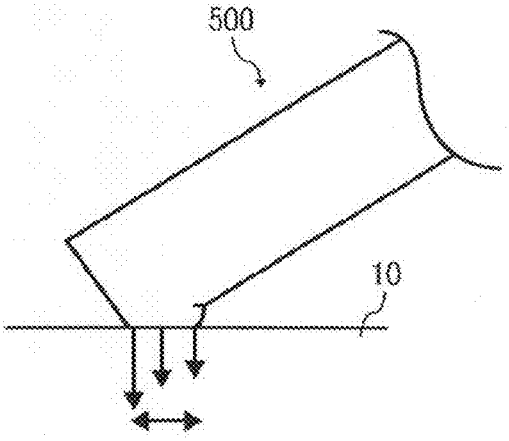
FIG. 10 is a cross-sectional view illustrating a contact portion between the photoreceptor and a cleaning blade having a smaller 100% modulus.

By contrast, FIG. 10 is a cross-sectional view illustrating a contact portion between the photoreceptor 10 and the cleaning blade 500 when the cleaning blade 500 is made of a material having a smaller 100% modulus value. When the cleaning blade 500 constructed of a material whose hardness and 100% modulus value are small contacts the photoreceptor 10, the width of the contact nip therebetween increases, and high peak pressure is not attained. Accordingly, when minute projections are formed on the surface of the photoreceptor 10, it is difficult to abrade the projections, making the surface smooth.

In view of the foregoing, in the cleaning blade 5 according to the first embodiment, the edge layer 1 that contacts the photoreceptor 10 is formed of a material whose hardness and 100% modulus value are higher, whereas the backup layer 2 is formed of a material whose hardness and 100% modulus value are lower than those of the edge layer 1.

With this configuration of the edge layer 1, the width of the contact nip between the cleaning blade 5 and the photoreceptor 10 is not unnecessarily wide, and the edge layer 1 can attain the high peak pressure required for blocking small toner particles having a higher circularity. Additionally, when minute projections are formed on the surface of the photoreceptor 10 corresponding to the surface unevenness of the charging roller 41, such a material can attain high peak pressure required to abrade the projections, making the surface smooth. However, a single-layer blade made of the material of hardness and 100% modulus value suitable for the edge layer 1 tends to wear relatively easily, and it is difficult to keep a stable line pressure regardless of the elapse of time, environmental changes, and the like.

Therefore, the backup layer 2 is formed of a material whose hardness and 100% modulus value are smaller than those of the edge layer 1. That is, the wear of the entire cleaning blade 5 can be inhibited by making the blade multilayered and forming the backup layer 2 with a material whose hardness and 100% modulus value are smaller than those of the edge layer 1. This configuration can restrict changes in cleaning performance, thus maintaining reliable cleaning performance for a long time.

Figure 11:
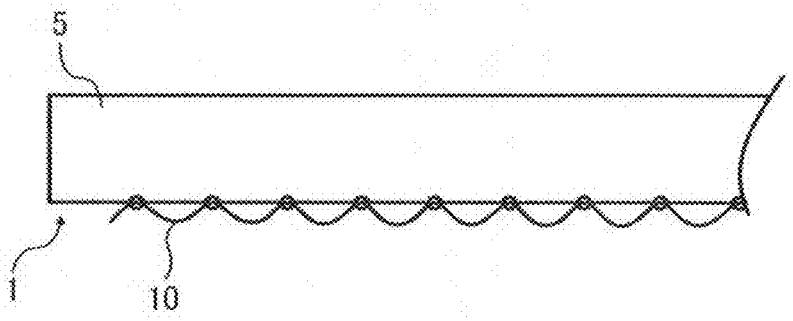
FIG. 11 is a front view illustrating a contact state between the photoreceptor and a cleaning blade having minute surface unevenness.

FIG. 11 is a front view illustrating a contact state between the photoreceptor 10 and the cleaning blade 5 having minute projections and recesses formed in its surface. In the cleaning blade 5 according to the present embodiment, the edge layer 1, which is constructed of the material having higher degree of hardness and 100% modulus, less conforms to the surface unevenness of the photoreceptor 10 and contacts only the projections. In this state, the peak pressure is high, the projections can be abraded, and the surface can become more uniform.

Figure 12:
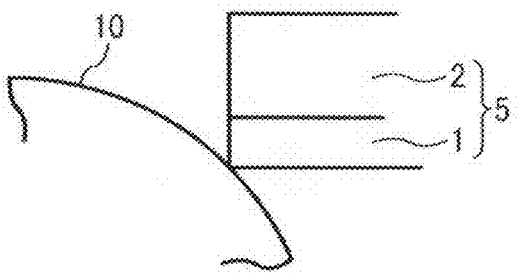
FIG. 12 is a cross-sectional view illustrating a state in which an end of an edge layer of the cleaning blade according to the first embodiment slidingly contacts the photoreceptor.
Figure 13:
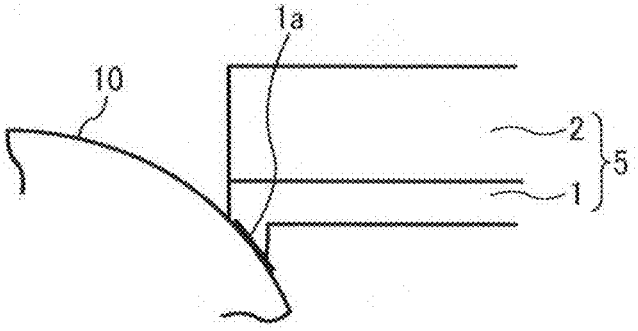
FIG. 13 is a cross-sectional view illustrating a state in which a side face of the edge layer of the cleaning blade slidingly contacts the photoreceptor.

FIGS. 12 and 13 are cross-sectional views illustrating states of contact between the edge layer 1 of the cleaning blade 5 and the photoreceptor 10. For example, as shown in FIG. 12, the edge of the edge layer 1 slidingly contacts the surface of the photoreceptor 10 and makes the surface uniform under low temperature conditions. In FIG. 13, reference character 1*a* represents a face of the edge layer 1 that intersects the edge of the edge layer 1. As shown in FIG. 13, under high temperature conditions, the face 1*a* of the edge layer 1 slidingly contacts the surface of the photoreceptor 1 and smoothes the surface.

Specifically, an example combination of the edge layer 1 and the backup layer 2 according to the present embodiment is as follows. The edge layer 1 is formed of a urethane rubber material having a 100% modulus value (under 23° C.) from 6 to 12 megapascal (MPa), and the backup layer 2 is formed of a urethane rubber material having a 100% modulus value (under 23° C.) from 4 to 5 MPa. Additionally, the urethane rubber material of the edge layer 1 has a JISA rubber hardness of 80 degrees, and that of the backup layer 2 has a JISA rubber hardness of 75 degrees. The edge layer 1 is 0.5 mm and the backup layer 2 is 1.3 mm in thickness, for example.

As described above, the cleaning blade 5 according to the first embodiment can scrape off toner and other substances from the photoreceptor 10 and simultaneously smooth the surface of the photoreceptor 10 by abrading the projections thereon when the surface unevenness of the charging roller 41 causes minute unevenness in the surface of the photoreceptor 1. This configuration can inhibit defective cleaning resulting from toner particles entering in the recesses formed on the surface of the photoreceptor 10. Therefor, the image forming apparatus 100 according to the first embodiment can maintain reliable charging and cleaning performances for a long time.

It is to be noted that a lubrication device may be provided to the cleaning device 30. Lubrication can reduce the wear of the photoreceptor 10 and improve cleaning performance by stabilizing the edge of the cleaning blade 5, thus further extending the operational life. For example, lubrication devices usable in this configuration can be constructed of a solid lubricant, a lubricant supporter to support the solid lubricant, and a rotatable brush roller that contacts both the solid lubricant and the photoreceptor 10. In such lubrication devices, the brush roller scrapes off powdered lubricant from the solid lubricant and applies the powdered lubricant to the surface of the photoreceptor 10.

A description is now given of toner used in the image forming apparatus 50 according to illustrative embodiments.

In order to satisfy an increasing demand for higher quality images, a volume average particle size (Dv) of the toner is preferably in a range from 3 μm to 6 μm to reproduce microdots not less than 600 dpi. A ratio (Dv/Dn) of the volume average particle size (Dv) to the number average particle size (Dn) of the toner is preferably in a range from 1.00 to 1.40. As the ratio (Dv/Dn) approaches 1, the particle size distribution becomes narrower. The toner having a smaller particle size and a narrower particle size distribution can be uniformly charged and transferred. Therefore, higher quality images without background fogging can be produced, and a higher transfer rate can be achieved in the image forming apparatus 50 employing the electrostatic transfer system.

Figure 14:
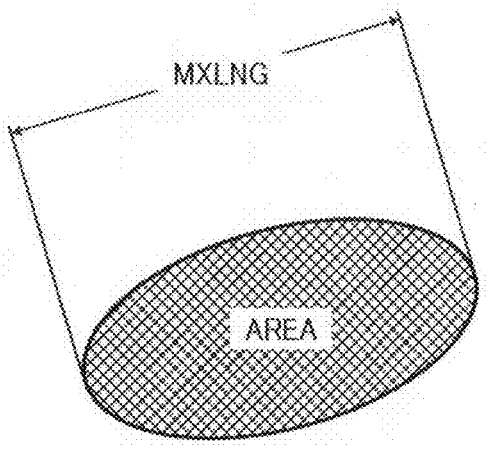
FIG. 14 is a schematic diagram illustrating a shape of a toner particle for understanding of shape factor SF-1.

The toner having high circularity with a shape factor SF-1 of from 100 to 180 and a shape factor SF-2 of from 100 to 180 is used in the image forming apparatus 50 according to illustrative embodiments. FIG. 14 is a schematic view illustrating a shape of toner for explaining the shape factor SF-1. The shape factor SF-1 represents a degree of roundness of a toner particle and is expressed by the following formula. The maximum length MXLGN of a toner particle projected on a two-dimensional surface is squared, divided by the area AREA of the toner particle, and then multiplied by 100π/4.

$$SF\text{-}1=\{(MXLNG)^2/AREA\}\times(100\pi/4)$$

The toner particle is a sphere when the first shape factor SF-1 is 100. As the first shape factor SF-1 increases, the toner particle becomes more amorphous.

Figure 15:
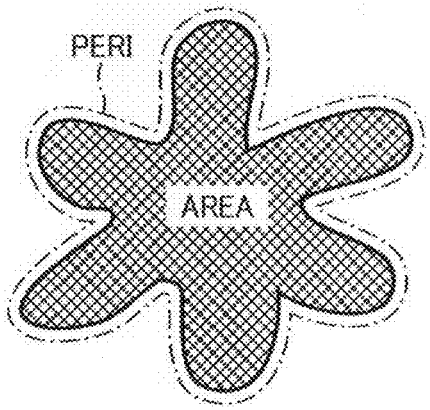
FIG. 15 is a schematic diagram illustrating a shape of a toner particle for understanding of shape factor SF-2.

FIG. 15 is a schematic view illustrating a shape of toner for explaining the shape factor SF-2. The second shape factor SF-2 shows a degree of irregularity of the toner particle shape and can be expressed by the formula below. The peripheral length PERI of a toner particle projected on a two-dimensional surface is squared, divided by the area AREA of the toner particle, and then multiplied by 100/(4π).

$$SF\text{-}2=\{(PELI)^2/AREA\}\times 100/(4\pi)$$

When the second shape factor SF-2 is 100, the surface of the toner particle has no concavities and convexities. As the second shape factor SF-2 becomes greater, the concavities and convexities thereon become more noticeable.

The shape factors can be measured by taking a picture of the toner particle with a scanning electron microscope S-800 from Hitachi, Ltd., and analyzing the picture with an image analyzer LUSEX 3 from Nireco Corporation to calculate the shape factors. When a shape of the toner particle becomes close to a sphere, toner particles contact each other as well as the photoconductors 1 in a point contact manner. Consequently, absorbability between the toner particles decreases, resulting in an increase in fluidity. Moreover, absorbability between the toner particles and the photoconductors 1 decreases, resulting in an increase in a transfer rate. When either the shape factor SF-1 or SF-2 is too large, the transfer rate deteriorates.

The toner preferably used for color image formation is obtained by a cross-linking reaction and/or an elongation reaction of a toner constituent liquid in an aqueous solvent. Here, the toner constituent liquid is prepared by dispersing a polyester prepolymer including a functional group having at least a nitrogen atom, a polyester, a colorant, and a releasing agent in an organic solvent. A description is now given of toner constituents and a method for manufacturing toner.

(Polyester)

The polyester is prepared by a polycondensation reaction between a polyalcohol compound and a polycarboxylic acid compound.

Specific examples of the polyalcohol compound (PO) include a diol (DIO) and a polyol having 3 or more valances (TO). The DIO alone, and a mixture of the DIO and a smaller amount of the TO are preferably used as the PO. Specific examples of the diol (DIO) include alkylene glycols (e.g., ethylene glycol, 1,2-propylene glycol, 1,3-propylene glycol, 1,4-butanediol, and 1,6-hexanediol), alkylene ether glycols (e.g., diethylene glycol, triethylene glycol, dipropyrene glycol, polyethylene glycol, polypropylene glycol, and polytetramethylene ether glycol), alicyclic diols (e.g., 1,4-cyclohexane dimethanol, and hydrogenated bisphenol A), bisphenols (e.g., bisphenol A, bisphenol F, and bisphenol S), alkylene oxide adducts of the above-described alicyclic diols (e.g., ethylene oxide, propylene oxide, and butylene oxide), and alkylene oxide adducts of the above-described bisphenols (e.g., ethylene oxide, propylene oxide, and butylene oxide). Among the above-described examples, alkylene glycols having 2 to 12 carbon atoms and alkylene oxide adducts of bisphenols are preferably used. More preferably, the alkylene glycols having 2 to 12 carbon atoms and the alkylene oxide adducts of bisphenols are used together. Specific examples of the polyol having 3 or more valances (TO) include aliphatic polyols having 3 to 8 or more valances (e.g., glycerin, trimethylolethane, trimethylol propane, pentaerythritol, and sorbitol), phenols having 3 or more valances (e.g., trisphenol PA, phenol novolac, and cresol novolac), and alkylene oxide adducts of polyphenols having 3 or more valances.

Specific examples of the polycarboxylic acids (PC) include dicarboxylic acids (DIC) and polycarboxylic acids having 3 or more valances (TC). The DIC alone, and a mixture of the DIC and a smaller amount of the TC are preferably used as the PC. Specific examples of the dicarboxylic acids (DIC) include alkylene dicarboxylic acids (e.g., succinic acid, adipic acid, and sebacic acid), alkenylene dicarboxylic acids (e.g., maleic acid and fumaric acid), and aromatic dicarboxylic acids (e.g., phthalic acid, isophthalic acid, terephthalic acid, and naphthalene dicarboxylic acid). Among the above-described examples, alkenylene dicarboxylic acids having 4 to 20 carbon atoms and aromatic dicarboxylic acids having 8 to 20 carbon atoms are preferably used. Specific examples of the polycarboxylic acids having 3 or more valances (TC) include aromatic polycarboxylic acids having 9 to 20 carbon atoms (e.g., trimellitic acid and pyromellitic acid). The polycarboxylic acid (PC) may be reacted with the polyol (PO) using acid anhydrides or lower alkyl esters (e.g., methyl ester, ethyl ester, and isopropyl ester) of the above-described materials.

A ratio of the polyol (PO) and the polycarboxylic acid (PC) is normally set in a range between 2/1 and 1/1, preferably between 1.5/1 and 1/1, and more preferably between 1.3/1 and 1.02/1 as an equivalent ratio [OH]/[COOH] between a hydroxyl group [OH] and a carboxyl group [COOH]. The polycondensation reaction between the polyol (PO) and the polycarboxylic acid (PC) is carried out by heating the PO and the PC to from 150° C. to 280° C. in the presence of a known catalyst for esterification such as tetrabutoxy titanate and dibutyltin oxide and removing produced water under a reduced pressure as necessary to obtain polyester having hydroxyl groups. The polyester preferably has a hydroxyl value not less than 5, and an acid value of from 1 to 30, and preferably from 5 to 20. When the polyester has the acid value within the range, the resultant toner tends to be negatively charged to have good affinity with a recording paper, and low-temperature fixability of the toner on the recording paper improves. However, when the acid value is too large, the resultant toner is not stably charged and the stability becomes worse by environmental variations. The polyester preferably has a weight-average molecular weight of from 10,000 to 400,000, and more preferably from 20,000 to 200,000. When the weight-average molecular weight is too small, offset resistance of the resultant toner deteriorates. By contrast, when the weight-average molecular weight is too large, lower-temperature fixability thereof deteriorates.

The polyester preferably includes a urea-modified polyester as well as an unmodified polyester obtained by the above-described polycondensation reaction. The urea-modified polyester is prepared by reacting a polyisocyanate compound (PIC) with a carboxyl group or a hydroxyl group at the end of the polyester obtained by the above-described polycondensation reaction to form a polyester prepolymer (A) having an isocyanate group, and reacting amine with the polyester prepolymer (A) to crosslink and/or elongate a molecular chain thereof. Specific examples of the polyisocyanate compound (PIC) include aliphatic polyisocyanates (e.g., tetramethylene diisocyanate, hexamethylene diisocyanate, and 2,6-diisocyanate methylcaproate), alicyclic polyisocyanates (e.g., isophoron diisocyanate and cyclohexyl methane diisocyanate), aromatic diisocyanates (e.g., trilene diisocyanate and diphenylmethane diisocyanate), aromatic aliphatic diisocyanates (e.g., α,α,α',α'-tetramethyl xylylene diisocyanate), isocyanurates, materials blocked against the polyisocyanate with phenol derivatives, oxime, caprolactam or the like, and combinations of two or more of the above-described materials. The PIC is mixed with the polyester such that an equivalent ratio [NCO]/[OH] between an isocyanate group [NCO] in the PIC and a hydroxyl group [OH] in the polyester is typically in a range between 5/1 and 1/1, preferably between 4/1 and 1.2/1, and more preferably between 2.5/1 and 1.5/1. When [NCO]/[OH] is too large, lower-temperature fixability of the resultant toner deteriorates. When [NCO]/[OH] is too small, a urea content in ester of the modified polyester decreases and hot offset resistance of the resultant toner deteriorates. The polyester prepolymer (A) typically includes a polyisocyanate group of from 0.5 to 40% by weight, preferably from 1 to 30% by weight, and more preferably from 2 to 20% by weight. When the content is too small, hot offset resistance of the resultant toner deteriorates, and in addition, the heat resistance and lower-temperature fixability of the toner also deteriorate. By contrast, when the content is too large, lower-temperature fixability of the resultant toner deteriorates. The number of the isocyanate groups included in a molecule of the polyester prepolymer (A) is at least 1, preferably from 1.5 to 3 on average, and more preferably from 1.8 to 2.5 on average. When the number of the isocyanate group is too small per 1 molecule, the molecular weight of the urea-modified polyester decreases and hot offset resistance of the resultant toner deteriorates.

Specific examples of amines (B) reacted with the polyester prepolymer (A) include diamines (B1), polyamines (B2) having 3 or more amino groups, amino alcohols (B3), amino mercaptans (B4), amino acids (B5), and blocked amines (B6) in which the amines (B1 to B5) described above are blocked.

Specific examples of the diamines (B1) include aromatic diamines (e.g., phenylene diamine, diethyltoluene diamine, and 4,4'-diaminodiphenyl methane), alicyclic diamines (e.g., 4,4'-diamino-3,3'-dimethyldicyclohexylmethane, diamine cyclohexane, and isophoron diamine), and aliphatic diamines (e.g., ethylene diamine, tetramethylene diamine, and hexamethylene diamine). Specific examples of the polyamines (B2) having three or more amino groups include diethylene triamine and triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds prepared by reacting one of the amines B1 to B5 described above with a ketone such as acetone, methyl ethyl ketone and methyl isobutyl ketone; and oxazoline compounds. Among the above-described amines (B), diamines (B1) and a mixture of the B1 and a smaller amount of B2 are preferably used.

A mixing ratio [NCO]/[NHx] of the content of isocyanate groups in the prepolymer (A) to that of amino groups in the amine (B) is typically from 1/2 to 2/1, preferably from 1.5/1 to 1/1.5, and more preferably from 1.2/1 to 1/1.2. When the mixing ratio is too large or small, molecular weight of the urea-modified polyester decreases, resulting in deterioration of hot offset resistance of the toner.

The urea-modified polyester may include a urethane bonding as well as a urea bonding. The molar ratio (urea/urethane) of the urea bonding to the urethane bonding is typically from 100/0 to 10/90, preferably from 80/20 to 20/80, and more preferably from 60/40 to 30/70. When the content of the urea bonding is too small, hot offset resistance of the resultant toner deteriorates.

The urea-modified polyester is prepared by a method such as a one-shot method. The PO and the PC are heated to from 150° C. to 280° C. in the presence of a known esterification catalyst such as tetrabutoxy titanate and dibutyltin oxide, and removing produced water while optionally depressurizing to prepare polyester having a hydroxyl group. Next, the polyisocyanate (PIC) is reacted with the polyester at from 40° C. to 140° C. to form a polyester prepolymer (A) having an isocyanate group. Further, the amines (B) are reacted with the polyester prepolymer (A) at from 0° C. to 140° C. to form a urea-modified polyester.

When the polyisocyanate (PIC), and the polyester prepolymer (A) and the amines (B) are reacted, a solvent may optionally be used. Specific examples of the solvents include inactive solvents with the PIC such as aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide), and ethers (e.g., tetrahydrofuran).

A reaction terminator may optionally be used in the cross-linking and/or the elongation reaction between the polyester prepolymer (A) and the amines (B) to control a molecular weight of the resultant urea-modified polyester. Specific examples of the reaction terminators include monoamines (e.g., diethylamine, dibutylamine, butylamine and laurylamine), and their blocked compounds (e.g., ketimine compounds).

The weight-average molecular weight of the urea-modified polyester is not less than 10,000, preferably from 20,000 to 10,000,000, and more preferably from 30,000 to 1,000,000. When the weight-average molecular weight is too small, hot offset resistance of the resultant toner deteriorates. The number-average molecular weight of the urea-modified polyester is not particularly limited when the above-described unmodified polyester resin is used in combination. Specifically, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is too large, low temperature fixability of the resultant toner and glossiness of full-color images deteriorate.

A combination of the urea-modified polyester and the unmodified polyester improves low temperature fixability of the resultant toner and glossiness of full-color images produced thereby, and is more preferably used than using the urea-modified polyester alone. Further, the unmodified polyester may include modified polyester other than the urea-modified polyester.

It is preferable that the urea-modified polyester at least partially mixes with the unmodified polyester to improve the low temperature fixability and hot offset resistance of the resultant toner. Therefore, the urea-modified polyester preferably has a composition similar to that of the unmodified polyester.

A mixing ratio between the unmodified polyester and the urea-modified polyester is from 20/80 to 95/5, preferably from 70/30 to 95/5, more preferably from 75/25 to 95/5, and even more preferably from 80/20 to 93/7. When the content of the urea-modified polyester is too small, the hot offset resistance deteriorates, and in addition, it is disadvantageous to have both high temperature preservability and low temperature fixability.

The binder resin including the unmodified polyester and urea-modified polyester preferably has a glass transition temperature (Tg) of from 45° C. to 65° C., and preferably from 45° C. to 60° C. When the glass transition temperature is too low, for example, lower than 45° C., the high temperature preservability of the toner deteriorates. By contrast, when the glass transition temperature is too high, for example, higher than 65° C., the low temperature fixability deteriorates.

Because the urea-modified polyester is likely to be present on a surface of the parent toner, the resultant toner has better heat resistance preservability than known polyester toners even though the glass transition temperature of the urea-modified polyester is low.

(Colorant)

Specific examples of the colorants for use in the toner of the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR1, RN, and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G Brilliant Fast Scarlet, Brilliant Carmine BS, PERMANENT RED (F2R, F4R, FRL, FRLL, and F4RH), Fast Scarlet VD, VULCAN FAST RUBINE B, Brilliant Scarlet G; LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The toner preferably includes a colorant in an amount of from 1 to 15% by weight, and more preferably from 3 to 10% by weight.

The colorant for use in the present invention can be combined with a resin to be used as a master batch. Specific examples of the resin for use in the master batch include, but are not limited to, styrene polymers and substituted styrene polymers (e.g., polystyrenes, poly-p-chlorostyrenes, and polyvinyltoluenes), copolymers of vinyl compounds and the above-described styrene polymers or substituted styrene polymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination. (Charge Controlling Agent)

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are from Orient Chemical Industries Co., Ltd.; TP-302 and TP-415 (molybdenum complex of quaternary ammonium salt), which are from Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are from Hoechst AG; LR1-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among the above-described examples, materials negatively charging the toner are preferably used.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of the developing roller attracting the toner increases, resulting in deterioration of the fluidity of the toner and image density of the toner images.

(Release Agent)

Wax for use in the toner as a release agent has a low melting point of from 50° C. to 120° C. When such a wax is included in the toner, the wax is dispersed in the binder resin and serves as a release agent at a location between a fixing roller and the toner particles. Accordingly, hot offset resistance can be improved without applying a release agent, such as oil, to the fixing roller. Specific examples of the release agent include natural waxes including vegetable waxes such as carnauba wax, cotton wax, Japan wax and rice wax; animal waxes such as bees wax and lanolin; mineral waxes such as ozokelite and ceresine; and petroleum waxes such as paraffin waxes, microcrystalline waxes, and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes, and ether waxes. Further, fatty acid amides such as 1,2-hydroxylstearic acid amide, stearic acid amide, and phthalic anhydride imide; and low molecular weight crystalline polymers such as acrylic homopolymer and copolymers having a long alkyl group in their side chain such as poly-n-stearyl methacrylate, poly-n-laurylmethacrylate, and n-stearyl acrylate-ethyl methacrylate copolymers can also be used.

The above-described charge control agents and release agents can be dissolved and dispersed after kneaded upon application of heat together with a master batch pigment and a binder resin, and can be added when directly dissolved or dispersed in an organic solvent.

(External Additives)

An external additive is preferably added to toner particles to improve the fluidity, developing property, and charging ability. The inorganic fine particles preferably have a primary particle size of from 5×10-3 μm to 2 μm, and more preferably, from 5×10-3 μm to 0.5 μm. In addition, the inorganic fine particles preferably has a specific surface area measured by a BET method of from 20 to 500 $m^2/g$. The content of the external additive is preferably from 0.01 to 5% by weight, and more preferably from 0.01 to 2.0% by weight, based on total weight of the toner composition.

Specific examples of inorganic fine particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among the above-described examples, a combination of a hydrophobic silica and a hydrophobic titanium oxide is preferably used. In particular, particles of those having an average particle size not greater than 5×10-4 μm are mixed, electrostatic force with the toner particles and Van der Waals force can increase considerably. Accordingly, even when toner particles are agitated in the developing device to attain a desired amount of charge, the external additive is rarely released from the toner particles. As a result, image failure such as white spots and image omission hardly occur. Further, the amount of residual toner after image transfer can be reduced. When fine particles of titanium oxide are used as the external additive, the resultant toner can reliably form toner images having a proper image density even when environmental conditions are changed. However, the charge rising properties of the resultant toner tend to deteriorate. Therefore, an additive amount of the titanium oxide fine particles is preferably smaller than that of silica fine particles. The amount in total of fine particles of hydrophobic silica and hydrophobic titanium oxide added is preferably from 0.3 to 1.5% by weight based on weight of the toner particles to reliably form higher-quality images without degrading charge rising properties even when images are repeatedly formed.

A method for manufacturing the toner is described in detail below, but is not limited thereto.

(Toner Manufacturing Method)

(1) The colorant, the unmodified polyester, the polyester prepolymer having an isocyanate group, and the release agent are dispersed in an organic solvent to obtain toner constituent liquid.

Volatile organic solvents having a boiling point lower than 100° C. are preferable because such organic solvents can be removed easily after formation of parent toner particles. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, and methylisobutylketone. The above-described materials can be used alone or in combination. In particular, aromatic solvent such as toluene and xylene, and chlorinated hydrocarbon such as methylene chloride, 1,2-dichloroethane, chloroform, and carbon tetrachloride are preferably used. The toner constituent liquid preferably includes the organic solvent in an amount of from 0 to 300 parts by weight, more preferably from 0 to 100 parts by weight, and even more preferably from 25 to 70 parts by weight based on 100 parts by weight of the prepolymer.

(2) The toner constituent liquid is emulsified in an aqueous medium under the presence of a surfactant and a particulate resin.

The aqueous medium may include water alone or a mixture of water and an organic solvent. Specific examples of the organic solvent include alcohols such as methanol, isopropanol, and ethylene glycol; dimethylformamide; tetrahydrofuran; cellosolves such as methyl cellosolve; and lower ketones such as acetone and methyl ethyl ketone.

The toner constituent liquid includes the aqueous medium in an amount of from 50 to 2,000 parts by weight, and preferably from 100 to 1,000 parts by weight based on 100 parts by weight of the toner constituent liquid. When the amount of the aqueous medium is too small, the toner constituent liquid is not well dispersed and toner particles having a predetermined particle size cannot be formed. By contrast, when the amount of the aqueous medium is too large, production costs increase.

A dispersant such as a surfactant or an organic particulate resin is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives, and imidazoline) and quaternary ammonium salts (e.g., alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amide derivatives and polyhydric alcohol derivatives; and ampholytic surfactants such as alanine, dodecyldi(aminoethyl)glycin, di(octylaminoethyle)glycin, and N-alkyl-N,N-dimethylammonium betaine.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-[ω-fluoroalkyl(C6-C11)oxy]-1-alkyl(C3-C4) sulfonate, sodium-[ω-fluoroalkanoyl(C6-C8)-N-ethylamino]-1-propane sulfonate, fluoroalkyl(C11-C20) carboxylic acids and their metal salts, perfluoroalkylcarboxylic acids (C7-C13) and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, and monoperfluoroalkyl(C6-C16)ethylphosphates.

Specific examples of commercially available surfactants include SURFLON® S-111, SURFLON® S-112, and SURFLON® S-113 manufactured by AGC Seimi Chemical Co., Ltd.; FRORARD FC-93, FC-95, FC-98, and FC-129 manufactured by Sumitomo 3M Ltd.; UNIDYNE DS-101 and DS-102 manufactured by Daikin Industries, Ltd.; MEGAFACE F-110, F-120, F-113, F-191, F-812, and F-833 manufactured by DIC Corporation; EFTOP EF-102, EF-103, EF-104, EF-105, EF-112, EF-123A, EF-123B, EF-306A, EF-501, EF-201, and EF-204 manufactured by JEMCO Inc.; and FUTARGENT F-100 and F-150 manufactured by Neos Co., Ltd.

Specific examples of cationic surfactants include primary and secondary aliphatic amines or secondary amino acid having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts. Specific examples of commercially available products thereof include SURFLON® S-121 manufactured by AGC Seimi Chemical Co., Ltd.; FRORARD FC-135 manufactured by Sumitomo 3M Ltd.; UNIDYNE DS-202 manufactured by Daikin Industries, Ltd.; MEGAFACE F-150 and F-824 manufactured by DIC Corporation; EFTOP EF-132 manufactured by JEMCO Inc.; and FUTARGENT F-300 manufactured by Neos Co., Ltd.

The resin particles are added to stabilize parent toner particles formed in the aqueous medium. Therefore, the resin particles are preferably added so as to have a coverage of from 10% to 90% over a surface of the parent toner particles. Specific examples of the resin particles include polymethylmethacrylate particles having a particle size of 1 nm and 3 μm, polystyrene particles having a particle size of 0.5 nm and 2 μm, and poly(styrene-acrylonitrile) particles having a particle size of 1 μm. Specific examples of commercially available products thereof include PB-200H manufactured by Kao Corporation, SGP manufactured by Soken Chemical & Engineering Co., Ltd., Technopolymer SB manufactured by Sekisui Plastics Co., Ltd., SGP-3G manufactured by Soken Chemical & Engineering Co., Ltd., and Micropearl manufactured by Sekisui Chemical Co., Ltd. In addition, inorganic dispersants such as tricalcium phosphate, calcium carbonate, titanium oxide, colloidal silica, and hydroxy apatite can also be used.

To stably disperse toner constituents in water, a polymeric protection colloid may be used in combination with the above-described resin particles and an inorganic dispersant. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid, and maleic anhydride), (meth) acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide), vinyl alcohol and its ethers (e.g., vinyl methyl ether, vinyl ethyl ether, and vinyl propyl ether), esters of vinyl alcohol with a compound having a carboxyl group (e.g., vinyl acetate, vinyl propionate, and vinyl butyrate), acrylic amides (e.g., acrylamide, methacrylamide, and diacetoneacrylamide) and their methylol compounds, acid chlorides (e.g., acrylic acid chloride and methacrylic acid chloride), nitrogen-containing compounds (e.g., vinyl pyridine, vinyl pyrrolidone, vinyl imidazole, and ethylene imine), and homopolymer or copolymer having heterocycles of the nitrogen-containing compounds. In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds (e.g., methyl cellulose, hydroxyethyl cellulose, and hydroxypropyl cellulose) can also be used as the polymeric protective colloid.

The dispersion method is not particularly limited, and well-known methods such as low speed shearing methods, high-speed shearing methods, friction methods, high-pressure jet methods, and ultrasonic methods can be used. Among the above-described methods, the high-speed shearing methods are preferably used because particles having a particle size of from 2 to 20 μm can be easily prepared. When a high-speed shearing type dispersion machine is used, the rotation speed is not particularly limited, but the rotation speed is typically from 1,000 to 30,000 rpm, and preferably from 5,000 to 20,000 rpm. The dispersion time is not particularly limited, but is typically from 0.1 to 5 minutes for a batch method. The temperature in the dispersion process is typically from 0° C. to 150° C. (under pressure), and preferably from 40° C. to 98° C.

(3) While the emulsion is prepared, amines (B) are added thereto to react with the polyester prepolymer (A) having an isocyanate group.

This reaction is accompanied by cross-linking and/or elongation of a molecular chain. The reaction time depends on reactivity of an isocyanate structure of the polyester prepolymer (A) and amines (B), but is typically from 10 minutes to 40 hours, and preferably from 2 to 24 hours. The reaction temperature is typically from 0° C. to 150° C., and preferably from 40° C. to 98° C. In addition, a known catalyst such as dibutyltinlaurate and dioctyltinlaurate can be used as needed.

(4) After completion of the reaction, the organic solvent is removed from the emulsified dispersion (a reactant), and subsequently, the resulting material is washed and dried to obtain a parent toner particle.

The prepared emulsified dispersion is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid, and washed with water to remove the calcium phosphate from the parent toner particle. Besides the above-described method, the organic solvent can also be removed by an enzymatic hydrolysis.

(5) A charge control agent is provided to the parent toner particle, and fine particles of an inorganic material such as silica and titanium oxide are added thereto to obtain toner.

Well-known methods using a mixer or the like are used to provide the charge control agent and to add the inorganic fine particles.

Accordingly, toner having a smaller particle size and a sharper particle size distribution can be easily obtained. Further, the strong agitation in the process of removing the organic solvent can control the toner to have a shape between a spherical shape and a spindle shape, and a surface morphology between a smooth surface and a rough surface.

The toner used in the image forming apparatus 50 according to illustrative embodiments has a substantially spherical shape that can be defined as follows.

Figure 16A:
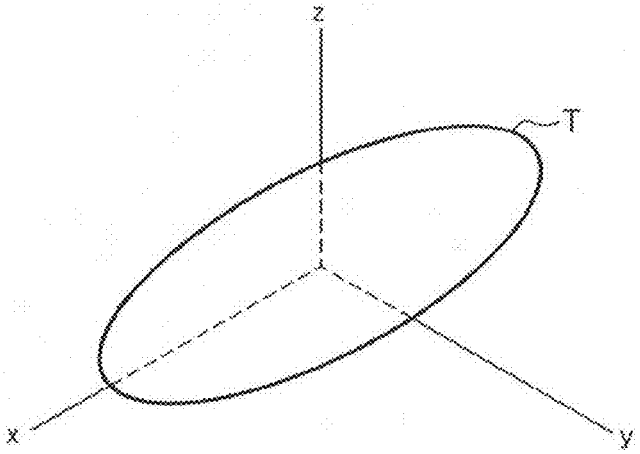
FIGS. 16A, 16B, and 16C illustrate toner shapes schematically.
Figure 16B:
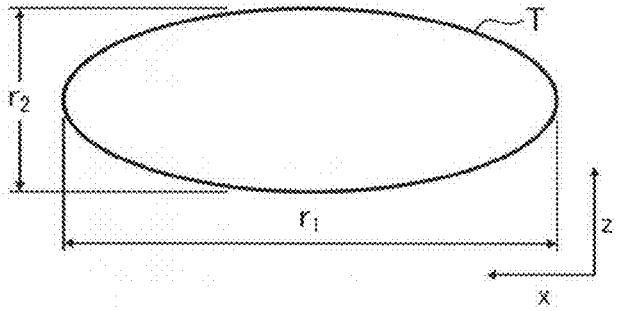
Figure 16C:
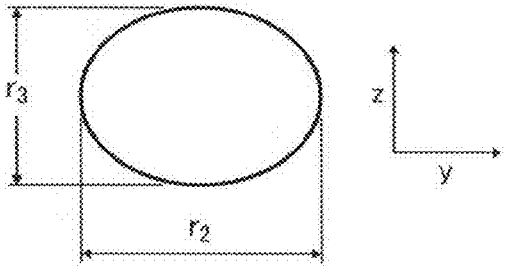

FIGS. 16A to 16C are schematic views respectively illustrating a shape of the toner.

The toner has a substantially spherical shape with a long axis $r_1$, a short axis $r_2$, and a thickness $r_3$ that satisfy the relation of $r_1 \geq r_2 \geq r_3$. It is preferable that a ratio $(r_2/r_1)$, shown in FIG. 16B, of the short axis $r_2$ to the long axis $r_1$ be in a range between 0.5 and 1.0, and a ratio $(r_3/r_2)$, shown in FIG. 16C, of the thickness $r_3$ to the short axis $r_2$ be in a range between 0.7 and 1.0.

When the ratio $(r_2/r_1)$ of the short axis $r_2$ to the long axis $r_1$ is less than 0.5, a shape of the toner is not spherical, and both dot reproducibility and transfer efficiency are decreased. When the ratio $(r_3/r_2)$ of the thickness $r_3$ to the short axis $r_2$ is less than 0.7, a shape of the toner is flattened.

Consequently, a high transfer ratio as obtained when the toner is spherical cannot be achieved. In particular, when the ratio $(r_3/r_2)$ of the thickness $r_3$ to the short axis $r_2$ is 1.0, the toner is rotated around the long axis $r_1$ as a rotary shaft, thereby improving flowability of the toner.

It is to be noted that each of $r_1$, $r_2$, $r_3$ was measured by taking pictures of the toner by a scanning electron microscope (SEM) at different viewing angles.

With the above-described configuration, the image forming apparatus 100 and the process cartridge 121 can have a long life with a reliable charge capability and a durable cleaning capability.

Second Embodiment

An image forming apparatus according to a second embodiment is described below.

In the second embodiment, configurations relating to the charging roller cleaner 42, which removes toner and other substances adhering to the charging roller 41 of the charging device 40, are different from those of the first embodiment. Descriptions about configurations, operation, action, and effects of the present embodiment similar to those of the first embodiment are omitted. Components identical or similar are given identical reference characters.

In the second embodiment, similarly the image forming apparatus 100 includes the process cartridges 121 for different colors, having a similar configuration. The process cartridge 121 includes the photoreceptor 10, and further includes the cleaning device 30, the charging device 40, and the developing device 50 disposed around the photoreceptor 10. The image forming apparatus 100 further includes, for each process cartridge 121, the exposure device 140 to expose the photoreceptor 10 and the primary-transfer roller 161 to transfer the toner image from the photoreceptor 10 onto the intermediate transfer belt 162.

In the charging device 40 according to the second embodiment, also minute projections and recesses extending in the circumferential direction are formed in the surface of the charging roller 41, and thus the area of the charging device 40 that contacts the photoreceptor 10 is reduced. Since the contact portions and the gaps are distributed in the axial direction, charging can be reliable. The reduction in the contact area of the charging roller 41 with the photoreceptor 10 is also advantageous in inhibiting the contamination of the photoreceptor 10 by the charging roller 41 and vice versa.

In roller charging employing charging rollers, if the cleaning device 30 fails to fully remove toner and the like from the photoreceptor 10, image failure can occur. For example, if toner additives remain on the surface of the photoreceptor 10, the resistance of the contaminated portion rises. In particular, although DC charging is advantageous in reducing the wear of the photoreceptor 10, the possibility of occurrence of image failure is higher compared with AC charging.

In view of the foregoing, the charging device 40 according to the present embodiment has the following features to improve the cleaning capability of the DC charging-type charging roller 41 capable of reducing the wear of the photoreceptor 10, thereby extending the operational lives of the photoreceptor 10, the charging roller 41, and the image forming apparatus 100.

The charging roller cleaner 42 that rotates while being contact with the charging roller 41 is constructed of a resin foam member having a continuous bubble structure in which the bubble diameter is smaller than a mean distance (interval) between projections creating the surface unevenness 8 of the charging roller 41. That is, the bubble diameter is smaller than a mean width of the recesses that are formed in the surface of the charging roller 41 and extend in the circumferential direction of the charging roller 41.

With such a configuration, the charging roller cleaner 42 can efficiently remove the toner and the like adhering to the surface of the charging roller 41 and inhibit the occurrence of image failure caused by contamination of the charging roller 41. Thus, the operational life of the image forming apparatus 100 can be extended. Additionally, use of resin foam of the continuous bubble structure is advantageous in that the removed substances, such as toner and toner additives, can be retained in the bubbles, thus inhibiting the substances from adhering again to the charging roller 41.

Since the charging roller 41 includes the surface unevenness 8, the surface area of the charging roller 41 that contacts the photoreceptor 10 can be reduced, and contact areas and gap areas can be reasonably distributed in the axial direction. Accordingly, the charging performance can be stable. Additionally, since the contact area is small, contamination of the photoreceptor 10 by the charging roller 41 and image failure due to the contamination of the charging roller 41 can be inhibited.

Herein, although the charging performance of the charging roller 41 can be stabilized by the surface unevenness 8 (formed by projections an and recesses extending in the circumferential direction) as described above, the projections and the recesses are present also in the axial direction of the charging roller 41. Therefore, it is preferred that the bubble diameter be smaller than the mean distance between the projections of the surface unevenness 8 in both the circumferential direction and the axial direction.

Further, by making the bubble diameter smaller than the mean distance between the projections in the circumferential direction, which can improve the charge performance reliability, the contamination of the photoreceptor 10 by the charging roller 41 and vice versa can be inhibited better.

Additionally, the resin foam is preferably melamine resin foam although urethane resin and the like can be used. In the second embodiment, melamine resin foam is used. Since melamine resin foam has relatively hard net-like fiber and can easily scrape off, or catch and peel, substances adhering to the surface of the charging roller 41. Accordingly, the capability of the charging roller cleaner 42 to remove toner and toner additives adhering can increase.

Additionally, by heat-compression molding, the bubble diameter of melamine resin foam can be reduced from that of the raw material. Typically, on the surface of the charging roller 41, projections (and recesses) are arranged at a mean distance from several tens to one hundred and several tens micron meters (μ), and the bubble diameter of raw melamine resin foam is one hundred and several tens micron meters. After the surface configuration of the charging roller 41 is decided according to the required charging performance, the rate of heat compression can be to make the bubble diameter smaller than the mean distance of the projections of the surface unevenness 8. Thus, by reducing the bubble diameter by heat-compression molding, the surface of the charging roller 41 can be cleaned effectively, thus inhibiting image failure and extending the operational life of the image forming apparatus 100.

It is to be noted that, as a heat compression method, the material may be made into a roller after blocks of raw material are heated and compressed. Alternatively, the raw material may be heated and compressed after the raw material is made into a roller and a metal core is inserted therein.

Additionally, similarly to the first embodiment, the cleaning device 30 includes the bilayer cleaning blade 5, and projections created on the surface of the photoreceptor 10 over time is abraded by the charging roller 41 that contacts the photoreceptor 10. Therefor, similarly to the first embodiment, the image forming apparatus 100 according to the second embodiment can maintain reliable charging and cleaning performances for a long time.

With the above-described configuration, similarly to the first embodiment, the image forming apparatus 100 and the process cartridge 121 according to the second embodiment can have a long life with a reliable charge capability and a durable cleaning capability. In addition, occurrence of image failure caused by contamination of the photoreceptor 10 by the charging roller 41 and contamination of the charging roller 41 by toner on the photoreceptor 10 can be inhibited, and the operational life of the charging device can be extended.

Third Embodiment

An image forming apparatus according to a third embodiment is described below.

The third embodiment is different from the first and second embodiments in that the surface layer of the photoreceptor 10 includes fine particles and that low-temperature fusing toner is used.

Descriptions about configurations, operation, action, and effects of the present embodiment similar to those of the first and second embodiments are omitted. Components identical or similar are given identical reference characters.

In the third embodiment, similarly the image forming apparatus 100 includes the process cartridges 121 for different colors, having a similar configuration. The process cartridge 121 includes the photoreceptor 10, and further includes the cleaning device 30, the charging device 40, and the developing device 50 disposed around the photoreceptor 10. The image forming apparatus 100 further includes, for each process cartridge 121, the exposure device 140 to expose the photoreceptor 10 and the primary-transfer roller 161 to transfer the toner image from the photoreceptor 10 onto the intermediate transfer belt 162.

In the charging device 40 according to the third embodiment, also minute projections and recesses extending in the circumferential direction are formed in the surface of the charging roller 41, and thus the area of the charging device 40 that contacts the photoreceptor 10 is reduced. Since the contact portions and the gaps are distributed in the axial direction, charging can be reliable. The reduction in the contact area of the charging roller 41 with the photoreceptor 10 is also advantageous in inhibiting the contamination of the photoreceptor 10 by the charging roller 41 and vice versa.

Additionally, the contact area of the photoreceptor 10 and toner particles is smaller, and toner base particles and additives are less likely to firmly adhere to the surface of the photoreceptor 10. That is, the occurrence of so-called filming can be inhibited.

The surface of the photoreceptor 10, however, wears over time due to damage caused by charging, and contact and sliding with the cleaning blade 5 and the charging roller 41. Accordingly, the surface may change from the initial surface configuration. Thus, it is possible that toner base particles and additives firmly adhere to the surface of the photoreceptor 10 like a film, and image failure, such as lines and image density unevenness, appears at the position of filming. In particular, the possibility of occurrence of toner filming increases when toner that excels in low-temperature fusing capability is used although such toner is advantageous in saving energy.

For example, the surface layer of the photoreceptor may include filler and has a surface roughness Rz from 0.4 to 1.0 μm so that the lubricant application device can reliably lubricate the photoreceptor, thereby securing the cleaning capability for a long time. Meanwhile, there is an increasing demand for omitting lubrication to reduce the cost and the size of image forming apparatuses.

When lubrication is omitted, however, the amount of abrasion (wear) of the photoreceptor increases, and it is difficult to maintain the surface roughness. Specifically, the surface roughness decreases in parts of the photoreceptor whereas the surface roughness increases in other parts of the photoreceptor, thus making the surface roughness uneven. Then, the photoreceptor includes areas in which filing occurs and areas in which filming does not occur, resulting in image failure such as linear stains, image density unevenness, or the like.

In view of the foregoing, in addition to the features of the above-described first and second embodiments, the third embodiment is characterized in that the photoreceptor 10 includes a surface layer including fine particles to suppress the occurrence of image failure resulting from filming.

Figure 17:
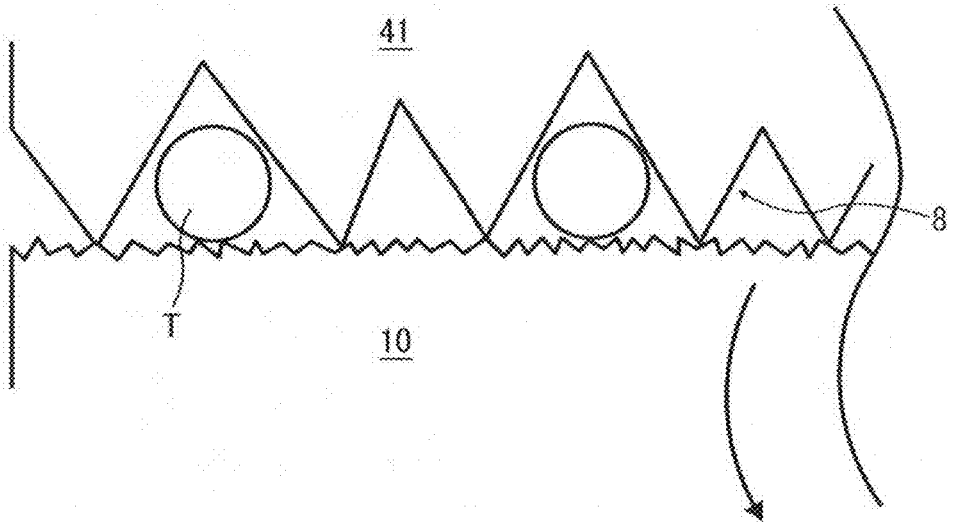
FIG. 17 is a schematic diagram illustrating a contact state of the charging roller and a photoreceptor according to a third embodiment.

FIG. 17 is a schematic diagram illustrating a contact state of the charging roller 41 and the photoreceptor 10 according to the third embodiment.

As shown in FIG. 17, the surface layer of the photoreceptor 10 includes fine particles that make the surface of the photoreceptor 10 uneven. Accordingly, filming of toner base and additives on the photoreceptor 10 can be inhibited.

Additionally, the charging roller 41 similarly includes the projections and recesses extending in the direction of rotation of the photoreceptor 10, and thus the contact area with the photoreceptor 10 is smaller. Accordingly, the charging roller 41 does not press toner against the photoreceptor 10 strongly. This configuration can inhibit contamination of the photoreceptor 10 by the charging roller 41, filming on the photoreceptor 10, and contamination of the charging roller 41 by toner and the like on the image bearer.

With the surface unevenness of the charging roller 41, the contacts areas and the gap areas can be reasonably distributed in the axial direction, and the charging performance can be stable. Since the damage to the photoreceptor 10 caused by electric discharge can become uniform, surface unevenness of the photoreceptor 10 can be maintained even when the photoreceptor 10 wears.

More specifically, the area of contact between the charging roller 41 and the photoreceptor 10 can be reduced further from that in the first embodiment by the projections and recesses of the charging roller 41 and those on the surface of the photoreceptor 10.

Additionally, most of toner base particles, and additives thereto, carried on the photoreceptor 10 can be caught in the gaps. Then, since both of the charging roller 41 and the photoreceptor 10 have surface unevenness, the area of contact between the photoreceptor 10 and toner base particles and additives thereto can be smaller compared with a case in which only one of them has surface unevenness.

These configurations can reduce the amount of toner base (and additives thereto) strongly pressed against the photoreceptor 10, thereby inhibiting occurrence of stain of the photoreceptor 10 by the charging roller 41, stains on the charging roller by toner from the photoreceptor 10, and filing on the photoreceptor 10.

Since both of the charging roller 41 and the photoreceptor 10 have the surface unevenness, contact areas and gap areas can be reasonably distributed. Accordingly, the chance of electrical discharge can increase, making the charging performance stable. Similarly, the damage caused by electrical discharge can correspond to the surface unevenness and be random, but equable, on the photoreceptor 10, which is less likely to cause unevenness in abrasion. Accordingly, the photoreceptor 10 can wear while maintaining the initial uneven surface structure. That is, the surface roughness of the photoreceptor 10 can be maintained over time.

Additionally, similarly to the first and second embodiments, the present embodiment employs DC charging in which only DC voltage is applied to the charging roller 41.

Therefore, load to the photoreceptor 10 can be reduced, and the amount of wear of the photoreceptor 10 can be reduced. Thus, the operational lives of the photoreceptor 10 and the image forming apparatus 100 can be longer.

Next, descriptions are given below of a layer structure of the photoreceptor 10 serving as the image bearer suitable for the present embodiment.

FIGS. 18A through 18D illustrate layer structures of the photoreceptor 10 according to the third embodiment.

Figure 18A:
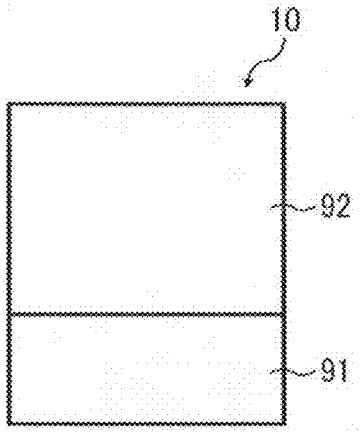
FIGS. 18A, 18B, 18C, and 18D illustrate layer structures of the photoreceptor according to the third embodiment.

FIG. 18A illustrates a layer structure in which the photosensitive layer 92 is formed on the conductive support member 91, and inorganic particles are present adjacent to the surface of the photosensitive layer 92.

Figure 18B:
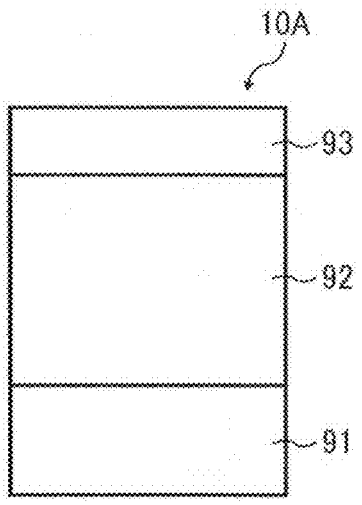
Figure 18C:
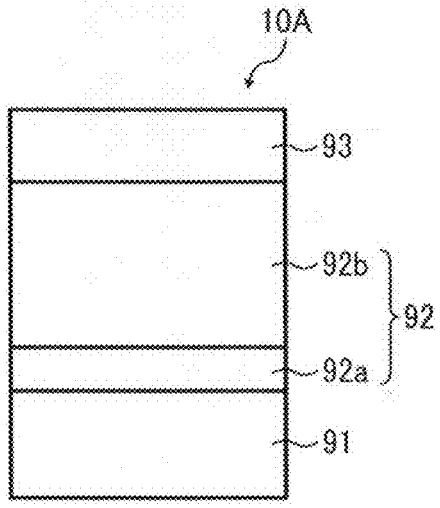

FIGS. 18B and 18C illustrate a photoreceptor 10A including a surface layer 93. Specifically, the layer structure shown in FIG. 18B includes a surface layer 93 including inorganic particles, formed on the photosensitive layer 92 overlying the conductive support member 91. The layer structure shown in FIG. 18C includes, from the bottom, the conductive support member 91, the photosensitive layer 92, and the surface layer 93 including inorganic particles; and the photosensitive layer 92 is constructed of a charge generation layer 92*a* and a charge transport layer 92*b*.

Figure 18D:
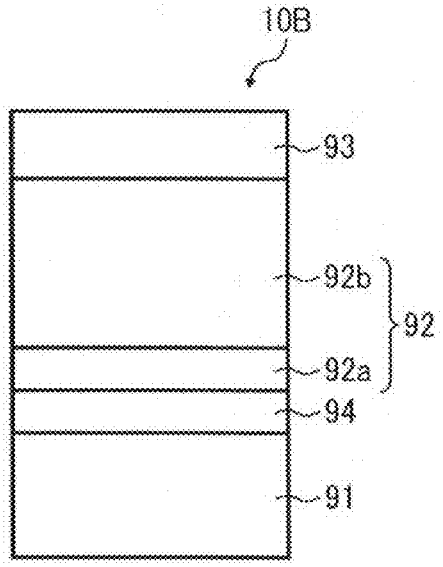

FIG. 18D illustrates a photoreceptor 10B that includes an under layer 91. Specifically, the layer structure shown in FIG. 18D includes, from the bottom, the conductive support member 91; the under layer 94, the photosensitive layer 92 constructed of the charge generation layer 92*a* and the charge transport layer 92*b*; and the surface layer 93 including inorganic particles.

The photoreceptors 10, 10A, and 10B according to the third embodiment (hereinafter collectively "photoreceptors 10 according to the third embodiment") includes at least the photosensitive layer 92 above the conductive support member 91, and inorganic particles are dispersed in the resin of the surface layer thereof. That is, the photoreceptor 10 according to the present embodiment includes, above the conductive support member 91, at least the photosensitive layer 92 including inorganic particle present adjacent to the surface, or includes the surface layer 93 in which inorganic particles are dispersed in the resin thereof. The photoreceptor 10 may further include one or more other layers combined freely.

The conductive support member 91 shown in FIGS. 18A to 18D can be formed of a material having a volume resistivity not greater than $10^{10}$ Ω·cm as electrical conductivity. For example, the conductive support member 91 can be formed by coating cylindrical or film-like plastic or paper with metal such as aluminum, nickel, chrome, nichrome, copper, silver, gold, and platinum; or metal oxide such as tin oxide and oxidation indium through vapor deposition or sputtering.

Alternatively, aluminum, aluminum alloy, nickel, or stainless steel plate can be made into a pipe by extrusion, drawing, or the like, and then the surface can be finished by machining, superfinish or polishing. Additionally, an endless belt made of nickel or stainless steel can be used as the conductive support member 91. In addition, the conductive support member 91 can be produced by coating the above-described support member with binder resin in which the above-described conductive powder is dispersed.

Examples of the conductive powder include carbon black; acetylene black; metal powder such as aluminum, nickel, iron, nichrome, copper, zinc, and silver; and metal oxide powder such as conductive tin oxide, indium tin oxide (ITO), and the like.

Further, examples of the binder resin used together include polystyrene, styrene-acrylonitrile copolymer, styrene-butadiene copolymer, styrene-maleic anhydride copolymer, polyester, polyvinyl chloride, vinyl chloride-vinyl acetate copolymer. The examples further include polyvinyl acetate, polyvinylidene chloride, polyarylate resin, phenoxy resin, polycarbonate, cellulose acetate resin, ethyl cellulose resin, polyvinyl butyral, polyvinyl formal, and polyvinyl toluene. Yet further the examples include thermoplastic resin, thermosetting resin, and light curable resin such as poly-N-vinylcarbazole, acrylic resin, silicone resin, epoxy resin, melamine resin, urethane resin, phenolic resin, alkyd resin.

Such a conductive layer can be produced through dispersion of the conductive powder and binder resin in a given solvent, such as tetrahydrofuran, dichloromethane, methyl ethyl ketone, toluene, and coating.

Additionally, also preferably used as the conductive support member 91 according to the third embodiment can be produced as follows. Using a thermally shrinkable tube in which the above-described conductive powder is included in a base such as polyvinyl chloride, polypropylene, polyester, polystyrene, polyvinylidene chloride, polyethylene, chlorinated rubber, Teflon (registered trademark), a conductive layer is produced on a cylindrical base.

Next, the photosensitive layer 92 is described below.

As shown in FIGS. 18A and 18B, the photosensitive layer 92 can be either single layered or multilayered. For the convenience, initially the configurations shown in FIGS. 18C and 18D including the charge generation layer 92*a* and the charge transport layer 92*b* are described. In these configurations, the actions of the photosensitive layer 92 are divided into the multiple layers (action-division type).

The charge generating layer 92*a* shown in FIGS. 18C and 18D includes a charge generating material as a main component. Known charge generating materials can be used for the charge generating layer 92*a*. Typical charge generating materials are mono azo pigments, disazo pigments, trisazo pigments, perylene pigments, perynone pigments, quinacridone pigments, quinone condensed polyacrylic compounds, squaric acid dyes, phthalocyanine pigments, naphthalocyanine pigments, and azulenium salt dyes.

The above-mentioned materials may be used alone or in combination.

In the third embodiment, azo pigment, phthalocyanine pigment, or both in combination are preferable. In particular, azo pigment and titanyl phthalocyanine are effective. In particular, preferably used titanyl phthalocyanine is the one whose Bragg's law 2θ diffraction peak against CuKα, characteristic X-ray (wavelength 1.514 Å) becomes maximum at least at 27.2° (±0.2°).

Additionally, the charge generating layer 92*a* can be produced as follows. Disperse the above-described charge generating material into solvent, together with binder resin as required, using a ball mill, Atligher, a sand mill, or ultrasonic wave, coat the conductive support member 91 with the dispersion liquid, and dry it.

The binder resin used for the charge generating layer 92*a* as required can be polyamide, polyurethane, epoxy resin, polyketone, polycarbonate, silicone resin, acrylic resin, polyvinyl butyral, polyvinyl formal, or polyvinyl ketone. Examples of the binder resin further includes polystyrene, polysulfonate, poly-N-vinylcarbazole, polyacryl amide, poly (vinyl benzal), polyester, phenoxy resin, vinyl chloride-vinyl acetate copolymer, polyvinyl acetate, polyphenylene oxide, and polyamide. Yet further the examples include polyvinyl pyridine, cellulose resin, casein, polyvinyl alcohol, and polyvinyl pyrrolidone.

The amount of binder resin can be within a range from 0 to 500 parts by weight, and preferably from 10 to 300 parts by weight, relative to 100 parts by weights of charge generating material.

Herein, the solvent usable to produce the charge generating layer 92*a* can be isopropanol, acetone, methyl ethyl ketone, cyclohexanone, tetrahydrofuran, dioxan, ethyl cellosolve, ethyl acetate, and acetic acid. Additionally, dichloromethane, dichloroethane, monochlorobenzene, xylene, and ligroin can be used. In particular, ketone solvent, ester solvent, ether solvent, and the like can be also preferably used.

The coating can be made through dipping, spraying, beat coating, nozzle coating, spinner coating, ring coating, and the like.

The charge generating layer 92*a* may have a layer thickness within a range from 0.01 μm to 5 μm, preferably from 0.1 μm to 2 μm.

The charge transport layer 92*b* can be formed by dissolving or dispersing the charge transport material together with binder resin in solvent, applying the solution onto the charge generating layer 92*a*, and drying it. As required, an elasticizer, a leveling agent, an antioxidant, and the like may be added thereto.

There are two types of charge transport materials, hole transporters and electron transporters.

Examples of electron transporters include electron acceptors such as chloranil, bromanil, tetracyanoethylene, tetracyanoquinodimethane, 2,4,7-trinitro-9-fluorenone, 2,4,5,7-tetranitro-9-fluorenone. The examples further include electron acceptors such as 2,4,5,7-tetranitro xanthone, 2,4,8-trinitro thioxanthone, and 2,6,8-trinitro-4H-indeno[1,2-b]thiophene-4-one. Yet further, there are electron acceptors such as 1,3,7-trinitro dibenzothiophene-5,5-dioxide and benzoquinone derivative.

Examples of hole transporters include poly-N-vinylcarbazole and derivatives thereof; poly-γ-carbazoyl ethyl glutamate and derivatives thereof; pyrene-formaldehyde condensate and derivatives thereof; polyvinylpyrene; and polyvinyl phenanthrene. Examples of hole transporters further include polysilane, oxazole derivative, oxadiazole derivative, imidazole derivative, monoaryl amine derivative, diaryl amine derivative, triarylamine derivative, stilbene derivative, and α-phenyl stilbene derivative. Examples further include benzidine derivative, diarylmethane derivative, triarylmethane derivative, 9-styrylanthracene derivative, pyrazoline derivative, divinylbenzene derivative, hydrazone derivative, indene derivative, butadiene derivative, and pyrene derivative. Further, bisstilbene derivative, enamine derivative, and other known materials can be used.

The above-mentioned charge transport materials may be used alone or in combination.

Examples usable as the binder resin include thermoplastic or thermosetting resin such as polystyrene, styrene-acrylonitrile copolymer, styrene-butadiene copolymer, styrene-maleic anhydride copolymer, polyester, polyvinyl chloride, and vinyl chloride-vinyl acetate copolymer. The examples further include thermoplastic or thermosetting resin such as polyvinyl acetate, polyvinylidene chloride, polyarylate, phenoxy resin, polycarbonate, cellulose acetate resin, ethyl cellulose resin, polyvinyl butyral, polyvinyl formal, and polyvinyl toluene. Yet further the examples include thermoplastic or thermosetting resin such as poly-N-vinylcarbazole, acrylic resin, silicone resin, epoxy resin, melamine resin, urethane resin, phenolic resin, alkyd resin.

The amount of charge transport material can be within a range from 20 to 300 parts by weight, and preferably from 40 to 150 parts by weight, relative to 100 parts by weights of binder resin.

The solvent usable to produce the charge transport layer 92*b* can be tetrahydrofuran, dioxan, toluene, dichloromethane, monochlorobenzene, dichloroethane, cyclohexanone, methyl ethyl ketone, acetone, or the like.

The layer thickness of the charge transport layer 92*b* is preferably equal to or smaller than 25 μm from the viewpoint of resolution and response. Although the lower limit varies depending on characteristics (charge potential, in particular) of the apparatus used, it is preferably 5 μm or greater.

In the photoreceptor 10 according to the third embodiment, the charge transport layer 92*b* may include an elasticizer, a leveling agent, or both.

Typical plasticizers for resins (e.g., dibutylphthalate and dioctylphthalate) can be used as is to produce charge transport layer 92*b*. A suitable usage amount of the plasticizer is 0 to about 30 weight percent to the binder resin.

As the leveling agent, silicone oil such as dimethyl silicone oil and methylphenyl silicone oil; polymer having a perfluoroalkyl group as lateral chains; or oligomers can be used. The weight ratio of the leveling agent to the binder resin is within a range from 0 to 1%.

When the charge transport layer 92*b* serves as the surface layer, inorganic particles are included in the charge transport layer 92*b*.

The inorganic particles included can be powder of metal such as copper, tin, aluminum, and indium; or inorganic material such as silicon oxide, silica, tin oxide, zinc oxide, titanium oxide, indium oxide, antimony oxide, and bismuth oxide. The examples further include metal oxide such as tin oxide in which antimony is doped, indium in which tin is doped; and inorganic material such as potassium titanate. Metal oxide is particularly preferable, and further silicon oxide, aluminum oxide, and titanium oxide are effective.

The inorganic particle preferably has a mean primary particle size from 0.01 to 0.5 μm considering the characteristics of the surface layer such as light transmission degree and resistivity against abrasion. It is to be noted that abrasion resistivity and the degree of dispersion decrease when the mean primary particle size is 0.01 μm or smaller. Additionally, when the mean primary particle size is 0.5 μm or greater, inorganic particles in the dispersion liquid can sink more easily, and toner filming can occur.

When the amount of inorganic particles added is large, abrasion resistivity is high, which is desirable. An extremely large amount of inorganic particles, however, causes side effects such as increases in residual potentials and decreases in the degree at which writing light transmits the protective layer. Generally, the amount of addition to the total solid amount is preferably 30% by weight or less, more preferably 20% by weight or less. The lower limit is generally 3% by weight.

The above-described inorganic particles can be treated with at least one surface treatment agent, which is preferable for facilitating the dispersion of inorganic particles.

Decreases in dispersion of inorganic particles can cause not only the rise of residual potentials but also degradation of transparency of coating, defective coating, and further degradation of abrasion resistivity. Accordingly, the decrease in dispersion of inorganic particles can hinder the extension of operational life or image quality improvement.

Next, the single-layer photosensitive layer 92 shown in FIGS. 18A and 18B is described.

When the photosensitive layer 92 is constructed of a single layer, as described above, the photoreceptor 10 includes the charge generating material dispersed in the binder resin.

The single-layer photosensitive layer 92 can be formed by dissolving or dispersing the electric charge generating material, the charge transport material, and the binder resin in solvent, applying the solution onto the support member 91, and drying it.

It is to be noted that, when the single-layer photosensitive layer 92 is the surface layer as shown in FIG. 18A, the photosensitive layer 92 includes the above-described inorganic particles.

As required, an elasticizer, a leveling agent, an antioxidant, and the like may be added thereto.

As the binder resin, the example binder resins listed in the description given above, regarding the charge transport layer 92*b*, can be used as is. In addition, the example binder resins listed in the description given above, regarding the charge generating layer 92*a* can be mixed therein.

The amount of charge generating material to 100 parts by weight of binder resin is preferably within a range from 5 to 40 parts by weight. The amount of charge transport material to 100 parts by weight of binder resin is preferably from 0 to 190 parts by weight, and more preferably from 50 to 150 parts by weight.

The single-layer photosensitive layer 92 can be produced as follows. Using a dispersing device, disperse the charge generating material and the binder resin in solvent, together with the charge transport material if necessary, coat the support member 91 with the dispersion liquid by dip coating, spraying, or beat coating.

Examples of solvent used to produce the single-layer photosensitive layer 92 include tetrahydrofuran, dioxan, dichloroethane, and cyclohexane. The thickness of the single-layer photosensitive layer 92 can be 5 to 25 μm.

Next, descriptions are given below of a layer structure of the photoreceptor 10B shown in FIG. 18D, that includes the under layer 94 between the conductive support member 91 and the photosensitive layer 92 (the charge generating layer 92*a* in particular).

Typically, the main component of the under layer 94 is resin, and use of resin resistive to typical organic solvents is preferred since the photosensitive layer 92 is applied thereto using solvent.

Examples of such resin include water-soluble resins (e.g., polyvinyl alcohol, casein, and sodium polyacrylate), alcohol fusible resins (e.g., interpolymerization nylon and methoxy methylation nylon), and cured resins (e.g., polyurethane, and melamine resin) that form three-dimensional network structures. The examples also include hardening resin (e.g., phenolic resin, alkyd-melamine resin, and epoxy resin) that form three-dimensional network structures.

The under layer 94 may include fine pigment particles of metal oxide to avoid moiré and to reduce residual potential. Examples of metal oxides include titanium oxide, silica, alumina, zirconia, tin oxide, and indium oxide.

The under layer 94 can be formed through coating using a given solvent, similarly to the photosensitive layer 92.

Additionally, in the third embodiment, a silane coupling agent, a titan coupling agent, a chrome coupling agent, or the like may be used for the under layer 94. Further, the under layer 94 may include an anodic oxidized $Al_2O_3$. Alternatively, the under layer 94 may be formed through a vacuum film-forming method using an organic compound (e.g., poly-para-xylylene or parylene) or an inorganic compound (e.g., $SiO_2$, $SnO_2$, $TiO_2$, ITO, $In_2O_3/SnO_2$, and $CeO_2$). Further, known materials may be used.

The under layer 94 can have a thickness within a range from 0 to 5 μm.

Next, descriptions are given below of the surface layer 93 (shown in FIGS. 18B, 18C, and 18D) that is formed above the photosensitive layer 92 (the charge transport layer 92*b* in particular) and includes inorganic particles.

The surface layer 93 includes at least inorganic particles and binder resin.

Examples of binder resin include thermoplastic resin such as polyarylate resin and polycarbonate resin; and cross-linking resin such as urethane resin and phenolic resin.

The fine particles can be either organic or inorganic.

Examples of organic particles include fluorine containing resin particles and carbonaceous particles.

By contrast, examples of inorganic particle include metal powder of copper, tin, aluminum, and indium. The examples further include silicon oxide, silica, tin oxide, zinc oxide, titanium oxide, indium, antimony oxide, bismuth oxide, metal oxide such as tin oxide in which antimony is doped, indium in which tin is doped and inorganic material such as potassium titanate. Metal oxide is particularly preferable, and further silicon oxide, aluminum oxide, and titanium oxide are effective.

The inorganic particle preferably has a mean primary particle size from 0.01 to 0.5 μm considering the characteristics of the surface layer 93 such as light transmission degree and resistivity against abrasion.

It is to be noted that abrasion resistivity and the degree of dispersion decrease when the mean primary particle size is 0.01 μm or smaller. Additionally, when the mean primary particle size is 0.5 μm or greater, inorganic particles in the dispersion liquid can sink more easily, and toner filming can occur.

When the amount of inorganic particles added to the surface layer 93 is large, abrasion resistivity is high, which is desirable. An extremely large amount of inorganic particles, however, causes side effects such as increases in residual potentials and decreases in the degree at which writing light transmits the protective layer. Generally, the amount of addition to the total solid amount is preferably 50% by weight or less, more preferably 30% by weight or less. The lower limit is generally 5% by weight.

The above-described inorganic particles can be treated with at least one surface treatment agent, which is preferable for facilitating the dispersion of inorganic particles.

Decreases in dispersion of inorganic particles can cause not only the rise of residual potentials but also degradation of transparency of coating, defective coating, and further degradation of abrasion resistivity. Accordingly, the decrease in dispersion of inorganic particles can hinder the extension of operational life or image quality improvement.

Conventional surface treatment agents can be used, but surface treatment agents capable of maintaining insulation of inorganic particles are preferable. Examples of the surface treatment agent include titanate coupling agents, aluminum coupling agents, zircoaluminate coupling agents, and higher fatty acids; and mixtures of silane coupling agents and those. Additionally, $A_2O_3$, $TiO_2$, $ZrO_2$, silicone, and aluminum stearate; and mixtures thereof can be used as the surface treatment agent. Such surface treatment agents are preferred from the viewpoint of dispersion of inorganic particles and image blurring.

Although treatment with silane coupling agents increases image blurring effects, the effects may be inhibited by mixing the above-described surface treatment agents in the silane coupling agent.

The amount of surface treatment is preferably from 3% by weight to 30% by weight and, more preferably, from 5% by weight to 20% by weight although it depends on the mean primary particle size of inorganic particle. If the amount of surface treatment is smaller than this range, dispersion of inorganic particles is insufficient, and, if the amount is extremely large, the residual potential can rise significantly.

The above-mentioned inorganic particles may be used alone or in combination.

The thickness of the surface layer 93 (or the photosensitive layer 92) is preferably within a range from 1.0 μm to 8.0 μm.

Since the photoreceptor 10 is repeatedly used for a long time, the photoreceptor 10 preferably has a high mechanical durability and does not easily abrade.

However, charging roller 41 of the charging device 40 and the like produce ozone and $NO_x$ gas inside the image forming apparatus 100, and such gas tends to adhere to the surface of the photoreceptor 10, causing image deletion. To prevent image deletion, it is necessary to abrade the surface layer 93 (or the photosensitive layer 92) at a predetermined velocity. Therefore, it is preferred that the surface layer 93 have a thickness of 1.0 μm or greater for the repeated use for a long time. When the thickness of the surface layer 93 is greater than 8.0 μm, the residual potential can rise and reproducibility of fine dots can be degraded.

The above-described inorganic particles added to the surface layer 93 (or the photosensitive layer 92) can be dispersed in the dispersion liquid in which the binder resin is also dispersed using a known dispersing device.

The average particle size of the inorganic particles in the dispersion liquid is preferably 1 μm or smaller and, more preferably, 0.5 μm or smaller considering the transmittance of the surface layer 93.

The surface layer 93 can be formed in the photosensitive layer 92 through dipping, ring coating, spray coating, and the like.

Among these methods, a typical method for forming the surface layer 93 is a spray coating in which the above-described dispersion liquid (coating material) is ejected as mist from nozzles having micro openings, and micro droplets of the mist adhere to the photosensitive layer 92, forming a coating layer.

The solvent usable here can be tetrahydrofuran, dioxan, toluene, dichloromethane, monochlorobenzene, dichloroethane, cyclohexanone, methyl ethyl ketone, acetone, or the like.

Further, the surface layer 93 can include an electric charge transport material to reduce the residual potential and improve the response. Materials similar to those used for the charge transport layer 92*b* can be used as the charge transport material added here.

When low-molecular electric charge transport materials are used as the electric charge transport material, there can be a density inclination in the surface layer 93. Further, polymeric electric charge transport materials having both capabilities of electric charge transport material and binder resin can be preferably used in the surface layer 93.

The surface layer 93 constructed of the above-described polymeric electric charge transport material can excel in abrasion resistivity. Known materials can be used as the polymeric electric charge transport material, and it is preferably at least a polymer selected from polycarbonate, polyurethane, polyester, and polyether. In particular, polycarbonate having a triarylamine structure in the main chain, side chain, or both is preferable.

The surface layer 93 of the photoreceptor 10 serving as the image bearer preferably has a Martens hardness of 190 $N/mm^2$ or greater and an elastic power (We/Wt) of 37.0% or greater.

The Martens hardness and elastic power used here can be measured under the conditions:

Evaluation device: Fisherscope H-100,

Test method: Loading-unloading repeat (once),

Indenter: Micro Vickers indenter,

Maximum load: 9.8 mN,

Loading (unloading) time: 30 seconds, and

Retention time: 5 seconds

If the Martens hardness is lower than 190 $N/mm^2$, toner can solidify on the surface of the photoreceptor 10. If the elastic power (We/Wt) is lower than 37.0%, wear speed of the photoreceptor 10 can fluctuate and wear unevenly when the image area ratio varies in the axial direction of the photoreceptor 10.

Therefore, the hardness and the elastic power are adjusted by changing the amount of inorganic particles added or the type of resin. Resins such as polycarbonate and polyarylate incorporate an inflexible structure in their resin skeletons and thus improve the hardness and the elastic power. Additionally, use of the polymeric electric charge transport material can enhance the hardness and the elastic power.

Additionally, the surface roughness Rz of the photoreceptor 10 is preferably within a range from 0.3 μm to 1.0 μm. For example, SURFCOM 1400D, manufactured by TOKYO SEIMITSU CO., LTD., can be used to measure the surface roughness of the photoreceptor 10.

The projections on the surface of the photoreceptor 10, having the above-described layer structure shown in FIGS. 18A to 18D, is abraded by the bilayer cleaning blade 5 similar to those of the first and second embodiments.

More specifically, in manufacturing, the inorganic particles included in the surface layer 93 create the initial surface unevenness of the photoreceptor 10. Then, the charging roller 41 having the projections and recesses extending in the circumferential direction further create projections and recesses over the initial surface unevenness, and the bilayer cleaning blade 5 similar to those of the first and second embodiments can abrade the projections created by the charging roller 41.

Therefor, similarly to the first and second embodiments, the third embodiment can provide an image forming apparatus capable of maintaining reliable charging and cleaning performances for a long time.

In the third embodiment, similarly, the charging roller cleaner 42 that rotates while being contact with the charging roller 41 can be constructed of the resin foam member having a continuous bubble structure in which the bubble diameter is smaller than the mean distance (interval) of projections (or recesses) of the surface unevenness 8 of the charging roller 41.

This configuration can further facilitate removal of toner and toner additives by the charging roller cleaner 42 and can inhibit the contamination of the photoreceptor 10 by the charging roller 41, toner filming, and contamination of the charging roller 41 by toner on the photoreceptor 10.

Next, developer usable in the present embodiment is described in further detail below. In the descriptions below, the term "parts" means "parts by mass".

In the third embodiment, developer that excels in low-temperature fusing capability is used to inhibit filming of toner and save energy.

Specifically, the toner in developer includes binder resin including crystalline resin and noncrystalline resin, and the base particle of toner is produced as follows. Dissolve or disperse in an organic solvent toner materials including at least the binder resin and a release agent, thus forming a dispersion liquid, and emulsify or disperse the dispersion liquid in an aqueous solvent. The crystalline resin is crystalline polyester resin, the noncrystalline resin is noncrystalline polyester resin, and the release agent is ester wax, for example. A peak endothermic temperature (melting point) Tm1 of the release agent and a peak endothermic temperature (melting point) Tm2 of the crystalline polyester resin satisfy the following formula 1.

$$Tm1 \leq Tm1 \leq Tm2 + 20^\circ\ C. \qquad \text{Formula 1}$$

The peak endothermic temperatures Tm1 and Tm2 are available using differential scanning calorimetry (DSC) analysis of toner. Further, the peak endothermic temperature (melting point) Tm2 and a flow start temperature Tfb of toner satisfy the following formula 2. Additionally, the melting point (a peak endothermic temperature in DSC analysis of simple substance of resin) of crystalline polyester resin is from 55° C. to 80° C.

$$Tm2 + 12^\circ\ C. < Tfb < Tm2 + 25^\circ\ C. \qquad \text{Formula 2}$$

Descriptions are given below of an example method for manufacturing developer that includes toner having the above-described features.

[Preparation of Toner 1]

(Synthesis of Ester Wax 1)

Charge a reaction vessel with a fatty acid component and an alcohol component, together with catalyst (in effective amount). Subject the mixture to esterification under nitrogen airflow at 240° C. Thus, ester wax 1 is prepared.

(Synthesis of Crystalline Polyester Resin 1)

Charge a 5-liter, four-neck flask equipped with a nitrogen inlet pipe, a dehydration pipe, a stirrer, and a thermocouple with 2,120 grams of 1,10-decanedioic acid, 1,520 grams of octane-1,8-diol, 1,200 grams of hexane-1,6-diol, and 4.9 grams of hydroquinone. Subject the mixture to a reaction at 180° C. for ten hours, then to a reaction at 200° C. for three hours, and further to a reaction at 8.3 kPa for two hours. Thus, crystalline polyester 1 is prepared.

(Synthesis of Noncrystalline Polyester Resin 1)

Charge a reaction vessel equipped with a condenser, a stirrer, and a nitrogen inlet pipe with 67 parts of ethylene oxide 2 mol adduct of bisphenol A, 84 parts of propione oxide 3 mol adduct of bisphenol A, 274 parts of terephthalic acid, and 2 parts of dibutyltin oxide. Subject the mixture to a reaction for eight hours, at 230° C., under normal pressure. Further subject the reaction liquid to a reaction for five hours, under reduced pressures of 10 to 15 mmHg. Thus, noncrystalline polyester resin 1 is prepared.

The noncrystalline polyester resin thus produced has a number average molecular weight (Mn) of 2,100, a mass average molecular weight (Mw) of 5,600, and a glass transition temperature (Tg) of 55° C.

(Preparation of Master Batch)

Using a Henschel mixer (manufactured by Mitsui Mining and Smelting Co., Ltd.), mix 1,000 parts of water, 540 parts of carbon black (Degussa Printex 35, DBP oil absorption of 42 ml per 100 g, pH 9.5), and 1,200 parts of the above-described unmodified polyester resin. Knead the resulting mixture by a double roll for 30 minutes at 150° C. Roll and cool the kneaded mixture and pulverize the rolled mixture into particles by a pulverizer from Hosokawa Micron Corporation. Thus, master batch (MB) 1 is prepared.

(Preparation of Crystalline Polyester Resin Dispersion Liquid)

Charge a two-liter metal vessel with 100 grams of crystalline polyester resin 1 and 400 grams of ethyl acetate, heat and melt the mixture at 70° C., and rapidly cool it in ice water at 20° C. per minute. After the cooling, 100 grams of dissolve the crystalline polyester resin 1 in the dispersion liquid, add to it 500 ml of glass beads having a diameter of 300 mm, and pulverize it for ten hours at a mean liquid temperature of 24° C. using a batch sand mill (from Kanpe Hapio Co., Ltd.). Thus, dispersion liquid 1 of crystalline polyester resin 1 having volume average particle size of 0.3 μm is produced.

(Synthesis of Polyester Prepolymer 1)

Charge a reaction vessel equipped with a condenser, a stirrer, and a nitrogen inlet pipe with the following materials, and subject the mixture to a reaction for eight hours at 230° C. under normal pressure. Further subject the mixture to a reaction for five hours under reduced pressures of 10 to 15 mmHg. Thus, intermediate polyester 1 is prepared. 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide.

The intermediate polyester 1 has a number average molecular weight of 2,100, a mass average molecular weight of 9,500, a glass transition temperature (Tg) of 55° C., an acid value of 0.5, and a hydroxyl value of 51.

Charge a reaction vessel equipped with a condenser, a stirrer, and a nitrogen inlet pipe with 410 parts of the intermediate polyester 1, 89 parts of isophorone diisocyanate, and 500 parts of ethyl acetate. Subject the mixture to a reaction for five hours at 100° C. Thus, polyester prepolymer 1 is prepared.

The polyester prepolymer includes 1.53% by mass of free isocyanates.

(Preparation of Pigment-Wax Dispersion Liquid 1, Oily Phase)

Charge a reaction vessel equipped with a stirrer and a thermometer with 378 parts of the noncrystalline polyester resin 1, 110 parts of ester wax 1, and 947 parts of ethyl acetate. Heat the mixture to 80° C. while agitating it, keep it at 80° C. for five hours, and cool it to 30° C. over a period of 1 hour. Further mix 500 parts of the master batch 1 and 500 parts of ethyl acetate in the mixture for 1 hour, thus producing material dissolution liquid 1.

Thereafter, put 1,324 parts of the material dissolution liquid 1 in a vessel, and disperse carbon black and wax by three times (3 passes) of dispersing operation using a bead mill (ULTRAVISCOMILL (trademark) from Aimex Co., Ltd.) under the conditions: a liquid feeding speed of 1 kg/hour, a disc peripheral speed of 6 msec, and filling conditions of 80% by volume of zirconia beads having a diameter of 0.5 mm.

After adding 1,042.3 parts of a 65% ethyl acetate solution of noncrystalline polyester resin 1, further subject the resulting mixture to the above dispersing operation once (1 pass). Thus, pigment-wax dispersion liquid 1 is prepared.

The pigment-wax dispersion liquid 1 thus prepared has a solid content of 50% (when measured at 130° C. for 30 minutes).

(Preparation of Particle Dispersion Liquid 1, Organic Particle Emulsion)

Charge a reaction vessel equipped with a stirrer and a thermometer with 683 parts of water, 11 parts of a sodium salt of a sulfate of ethylene oxide adduct of methacrylic acid (ELEMINOL RS-30 from Sanyo Chemical Industries, Ltd.), 138 parts of styrene, 138 parts of methacrylic acid, and 1 part of ammonium persulfate. Agitate the mixture for 15 minutes at a revolution of 400 rpm, thus obtaining a white emulsion. Then, raise the temperature to 75° C. and subject to a reaction for five hours.

Further add 30 parts of a 1% aqueous solution of ammonium persulfate to the emulsion, and age the mixture for five hours at 75° C. Thus, a particle dispersion liquid 1 that is an aqueous dispersion of a vinyl resin (i.e., a copolymer of styrene, methacrylic acid, and a sodium salt of a sulfate of ethylene oxide adduct of methacrylic acid) is prepared.

The particle dispersion liquid 1 thus prepared has a weight average particle size of 0.14 μm when measured by a particle size distribution analyzer LA-920 (from Horiba, Ltd.).

Dry out a part of the particle dispersion liquid 1 to isolate the resin therefrom.

(Preparation of Aqueous Phase 1)

Mix 990 parts of water, 83 parts of the resin particle dispersion 1, 37 parts of a 48.5% aqueous solution of dodecyl diphenyl ether sodium disulfonate (ELEMINOL MON-7 from Sanyo Chemical Industries, Ltd.), and 90 parts of ethyl acetate. Thus, aqueous phase 1 that is a milky liquid is prepared.

(Preparation or Emulsification of Dispersion Slurry 1)

Mix 664 parts of pigment-wax dispersion liquid 1, 109.4 parts of prepolymer 1, and 4.6 parts of ketimine compound 1 by a TK HOMOMIXER (from Primix Corporation) at a revolution of 5,000 rpm for one minute. Further mix 1,200 parts of the aqueous phase 1 therein by the TK HOMOMIXER at a revolution of 11,000 rpm for five minutes. Thus, emulsion slurry 1 is obtained.

Heat the emulsion slurry 1, contained in a vessel equipped with a stirrer and a thermometer, at 30° C. for eight hours to remove the organic solvent, and cause it to age at 45° C. for 4 hours. Thus, dispersion slurry 1 is prepared.

(Preparation of "Toner Base Particle B, Cleaning and Drying)

Filter 100 parts of the dispersion slurry 1 under reduced pressure and, thereby producing a wet cake. Subject the wet cake to the steps 1 to 4 below.

(1) Mix the wet cake with 100 parts of ion-exchange water by a TK HOMOMIXER at a revolution of 12,000 rpm for 10 minutes, followed by filtering.

(2) Mix the wet cake obtained by the step 1 with 100 parts of a 10% aqueous solution of sodium hydroxide by a TK HOMOMIXER at a revolution of 12,000 rpm for 30 minutes, followed by filtering under reduced pressure.

(3) Mix the wet cake obtained by the step 2, with 100 parts of a 10% hydrochloric acid by a TK HOMOMIXER at a revolution of 12,000 rpm for 10 minutes, followed by filtering.

(4) Add, to the wet case obtained by step 3, 300 parts of ion-exchange water, and dry it by a hot air dryer at 45° C. for 48 hours. Thus, toner base particle B is obtained.

(Preparation of Toner 1, External Addition)

Mix, to 100 parts of toner base particle B, 1.5 parts of silica A (UFP-35, from DENKI KAGAKU KOGYO KABUSHIKI KAISHA) using a Henschel mixer (from Mitsui Mining and Smelting Co., Ltd.) at a peripheral velocity of 13 m/s for one minute, and further mix it at a peripheral velocity of 40 m/s for ten minutes. Add to it 0.5 part of titanium oxide having volume average particle size of 20 mm, and agitate it by the Henschel mixer a peripheral velocity of 13 m/s for one minute, and further at a peripheral velocity of 40 m/s for ten minutes. Add to it 2.0 parts of silica B (H1303 from Clariant Japan Co., Ltd.), and agitate it by the Henschel mixer at a peripheral velocity of 13 m/s for one minute, and further at a peripheral velocity of 40 m/s for ten minutes. Further add to it 0.2 part of fatty acid metallic salt particles (zinc stearate 1), and agitate it by the Henschel mixer at a peripheral velocity of 13 m/s for one minute, and further at a peripheral velocity of 40 m/s for ten minutes.

Sift the mixed powder by a mesh having openings of 500 μm to remove large powdered particles. Thus, toner 1 to which fatty acid metallic salt and inorganic particles are added is prepared.

When the following properties of the toner 1 thus obtained are measured, flow start temperature Tfb (by a flow tester) is 80.2° C., wax melting point Tm1 (by a DSC) is 67.9° C., and crystalline polyester melting point Tm2 (by the DCS) is 64.3° C.

[Preparation of Carrier]

Add, to 100 parts of toluene, 100 parts of silicone resin, organo straight silicone, 5 parts of γ-((2-aminoethyl)-aminopropyltrimethoxysilane, and 10 parts of carbon black, and dispose the mixture for 20 minutes by a homomixer. Thus, resin coating liquid is prepared.

Subsequently, using a fluidized bed coating device, apply the resin coating liquid to a surface of 1000 parts of spherical magnetite having a volume average particle size of 50 μm. Thus, the carrier is prepared.

[Preparation of Developer 1]

Using a ball mill, mix 5 parts of toner 1 and 95 parts of carrier, thus forming developer 1.

Next, descriptions are given below of evaluation methods and evaluation results of effects attained by using developer 1 according to the third embodiment.

[Evaluation Method 1]

Using the developer 1 produced under the conditions below, the cleaning capability, the filming property, the low-temperature fusing capability, and uniformity of solid images formed on recording media were evaluated.

In the evaluation, a modification of Ricoh product, RICOH Pro C751 ex (hereinafter "modified apparatus 1") was used. In the modified apparatus 1, charging type, process linear velocity, and the development gap of the development device were variable. It is to be noted that the process linear velocity was 500 mm/s, charging was contact type, and development gap was 0.3 mm in the evaluation.

(Cleaning Capability)

After a chart having an image area ratio of 95% was recorded on 1,000 sheets and the photoreceptor 10 was cleaned, residual toner was transferred from the photoreceptor 10 onto white paper using Scotch tape (from Sumitomo 3M Limited) and measured by a Macbeth reflection densitometer, RD514.

According to the results, the difference from that of blank tape was less than 0.005, and thus the cleaning capability was deemed satisfactory.

(Filming)

After charts having image area ratios of 100%, 75%, and 50% were recorded on 1,000 sheets, respectively, filming on the developing roller and the photoreceptor were observed.

Although slight filming was observed, it was tolerable.

(Low-Temperature Fusing Capability)

Test copying was made on type 6200 paper from Ricoh. More specifically, a cold offset temperature (minimum fusing temperature) was determined by varying the fixing temperature, and the fusing capability was evaluated by the following standards.

The minimum fusing temperature was determined under the conditions that a paper feeding linear velocity of 120 to 150 mm/s, a contact pressure of 1.2 kgf/cm$^2$, and a nip width of 3 mm. The maximum fusing temperature was determined under the conditions that a paper feeding linear velocity of 50 mm/s, a contact pressure of 2.0 kgf/cm$^2$, and a nip width of 4.5 mm.

For reducing power consumption, the minimum fusing temperature is preferably lower, and a minimum fusing temperature of 130° C. or lower is satisfactory in practice.

In the measurement results, the minimum fusing temperature was 125° C. or lower.

(Solid-Image Uniformity)

Toner was put in a supply toner bottle and kept for four weeks under a 40° C. 60% Rh. Using the above-described developer and the supply toner bottle, a solid image was recorded on 100 sheets, and then solid image uniformity was evaluated.

In the measurement results, the solid image was uniform and the quality was good.

[Evaluation Method 2]

Using the developer 1 produced under the conditions below, the cleaning capability, the stain on the charging roller, the filming property, the low-temperature fusing capability, and uniformity of solid images formed on recording media were evaluated.

In the evaluation, a modification of Ricoh product, RICOH Imagio MP C4000 (hereinafter "modified apparatus 2") was used. It is to be noted that the modified apparatus 2 includes the photoreceptor 10, the cleaning blade 5, and the charging roller 41 according to the first embodiment.

(Cleaning Capability)

To check the occurrence of defective cleaning, 24,000 sheets in total were output under hot and humid condition (32° C. and 54% RH) and under cool and low-humidity condition (10° C. and 15% RH).

Under either of the two conditions, defective cleaning did not occur.

(Stain on Charging Roller)

To evaluate image failure caused by the stain on the charging roller 41, 36,000 sheets in total were output under cool, low-humidity conditions (10° C. and 15% RH).

In the evaluation results, there was no image failure caused by the stain of the charging roller 41.

[Filming]

After a chart having an image area ratio of 5% was recorded on 50,000 sheets, image density unevenness caused by filming was evaluated.

In the evaluation results, there was no image density unevenness caused by filming.

From the results of the evaluation methods 1 and 2, it is verified that, by maintaining reliable charging capability and the surface configuration of the photoreceptor 10 for a long time, image failure can be inhibited, and a long-life image forming apparatus having durable cleaning capability can be provided.

With the above-described configuration, similarly to the first and second embodiments, the image forming apparatus 100 and the process cartridge 121 according to the second embodiment can have a long life with a reliable charge capability and a durable cleaning capability. In addition, the amount of toner base (and additives thereto) strongly pressed against the photoreceptor 10 can be significantly reduced, thereby inhibiting occurrence of stain on the photoreceptor 10 by the charging roller 41, stain on the charging roller by toner from the photoreceptor 10, and filing on the photoreceptor 10.

(Variation 1)

A first variation of the third embodiment is described below.

The present variation is different from the third embodiment (and the first and second embodiments) in that different charging methods are used in the charging device 40K and the charging device 40Y, 40C, and 40M for colors other than black.

Accompanied by development in color image forming technologies, increases in speed, and image quality improvement, tandem image forming apparatuses, such as the image forming apparatus 100 shown in FIG. 1, that include four image forming units have become mainstream.

With increases in environmental awareness, high reliability, long operational life, and component recycling of image forming apparatuses are valued increasingly. Additionally, considering working environments, awareness of the amount of ozone and dust generated is increasing.

In response to these factors, in many electrophotographic image forming apparatuses, roller charging methods are used since the amount of ozone generated is smaller. Further, to respond to the demands for long operational life and high-image quality, AC charging, in which AC voltage is superimposed on DC voltage, is widely used since the charging current flows sufficiently and charge potentials can be stable.

However, in image forming apparatuses that involve AC charging, charging accompanies noise since the superimposed voltage in which AC voltage is superimposed on DC voltage is applied to the charging roller. In addition, although the amount of ozone generated in contact-type charging is smaller, the amount of charging current increases when AC voltage is applied, and thus the amount of ozone generated increases from that in a case where only DC voltage is applied. Therefore, in full-color image formation using four color toners, it is possible that the charging noise increases to be deemed abnormal noise by users and that the amount of ozone generated increases. To alleviate such inconveniences, although image forming apparatuses may further include soundproof members, ozone treatment system such as ozone filters, or both, this approach increases the size and the weight of the apparatus.

Further, generally the frequency of color image output is significantly less than that of monochrome image in offices. Accordingly, if the replacement cycle of image forming units (i.e., process cartridges) for colors other than black is the same as that of the black image forming unit, the image forming units for other colors may be wasted.

In view of the foregoing, in the present variation, the image forming apparatus 100 is configured to obviate the addition of soundproof members and the ozone treatment system and optimize the operational life of the black image forming unit and that of other color image forming units. Thus, increases in size and weight of the apparatus can be avoided and resources can be saved.

Specifically, in the image forming apparatus 100 according to the third embodiment, the superimposed voltage including AC voltage and DC voltage is applied to the charging roller 41K in the charging device 40K for black, whereas DC voltage is applied to the charging rollers 41Y, 40C, and 40M of the charging devices 40Y, 40C, and 40M for other color.

This configuration can inhibit increases in the charging noise to such a degree that users deem it abnormal noises and increases in the amount of ozone generated, in full-color image formation using four color toners. Therefore, the soundproof member and the ozone treatment system such as ozone filters are not added in the apparatus, and the size and the weight of the apparatus do not increase.

Additionally, when AC voltage is superimposed on DC voltage, the AC voltage can significantly increase the abrasion and degradation of the surface of the photoreceptor 10, and thus the surface is lubricated as a protection. In addition to protect the surface of the photoreceptor 10, application of lubricant can stabilize the behavior of the edge of the cleaning blade 5 and improve toner removal performance.

However, the size and the cost of the apparatus increase when four lubrication devices are used in the tandem image forming apparatus to lubricate the four image forming units.

By contrast, according to the first variation, only DC voltage is applied to the color image forming units other than the black image forming unit, and thus lubrication of the photoreceptors 10 for preventing abrasion and degradation thereof can be omitted. Thus, the size and the cost of the apparatus can be reduced in the first variation.

With the above-described configurations, in addition to the effects similar to those attained by the third embodiment, increases in the size and the weight of the apparatus can be inhibited, and resources can be saved.

(Variation 2)

A second variation of the third embodiment is described below.

The present variation is different from the first variation in that only the black image forming unit includes a lubrication device to lubricate the photoreceptor 10K.

Generally, the frequency of monochrome image output is higher than that of color image in offices, and it is preferred that the black image forming unit have a long operational life.

Accordingly, in the black image forming unit that employs AC charging in which AC voltage is superimposed on DC voltage, it is necessary to protect the photoreceptor 10K from charge hazard caused by AC component, thereby securing the long lives of the photoreceptor 10K and the image forming apparatus 100.

Therefore, in the present variation, only the black image forming unit includes a lubrication device to lubricate the photoreceptor 10K.

The lubricant applied to the photoreceptor 10K can stabilize the edge behavior of the bilayer cleaning blade 5, improve the cleaning capability and further the transfer capability.

With the above-described configurations, in addition to the effects similar to those attained by the third embodiment and the first variation, the operational lives of the photoreceptor 10, the process cartridge 121K, and the image forming apparatus 100 can be extended.

Although the above-described embodiments concern the intermediate-transfer image forming apparatus 100, embodiments of this specification are not limited thereto but also include, for example, direct-transfer image forming apparatuses.

Although the above-described embodiments concern the tandem image forming apparatus 100 including multiple image forming units (i.e., process cartridges), embodiments of the present invention are not limited thereto. The above-described configurations, except the first and second variations of the third embodiment, can adapt to single-color (i.e., monochrome) image forming apparatuses including a single image forming unit (i.e., process cartridge).

The various configurations according to the present inventions can attain specific effects as follows.

Aspect A: The image forming apparatus, such as the image forming apparatus 100, includes the image bearer, such as the photoreceptor 10, the charging member, such as the charging roller 41 of the charging device 40, to contact a surface of the image bearer and charge the image bearer, the exposure device 140 to expose the image bearer and form a latent image, the developing device 50 to develop the latent image on the image bearer into a toner image, the transfer device, such as the intermediate transfer unit 160, to transfer the toner image from the image bearer onto the transfer medium such as the intermediate transfer belt 162, and a blade, such as the cleaning blade 5 of the cleaning device 30, to remove toner from the image bearer after image transfer.

In this image forming apparatus, projections and recesses extending in the direction of rotation of the image bearer are formed in the surface of the charging member. The cleaning blade is configured such that the edge thereof abuts against the surface of the image bearer to remove toner remaining on the image bearer after image transfer and to abrade the projections on the surface of the image bearer.

With this configuration, the image forming apparatus can maintain reliable charging and cleaning capabilities for a long time as described in the first to third embodiments.

Aspect B: In aspect A, the cleaning blade is multilayered. With this configuration, among the multiple layers of the cleaning blade, the layer that contacts the image bearer can preferably abrade the projections formed on the surface of the image bearer by the charging member having the projections and recesses extending in the direction of rotation of the image bearer, as described in the first to third embodiments.

In addition, the other layer or other layers than the layer that contacts the image bearer can maintain a stable line pressure and secure a reliable cleaning capability regardless of elapse of operation time and environmental changes.

Aspect C: In aspect B, among the multiple layers of the cleaning blade, the edge layer including the edge that abuts against the image bearer is formed with a material having a greater 100% modulus value than that of other layer (or other layers). This configuration can preferably abrade the projections formed on the surface of the image bearer by the charging member having the projections and recesses extending in the direction of rotation of the image bearer, as described in the first to third embodiments.

The cleaning blade is multilayered and includes the edge layer 1 made of the material having higher hardness and 100% modulus value and the backup layer 2 made of the material having lower hardness and 100% modulus value, thereby inhibiting the wear of the entire cleaning blade 5. This configuration can restrict changes in cleaning performance, thus maintaining reliable cleaning performance for a long time.

Aspect D: In aspect B or C, among the multiple layers of the cleaning blade, the edge layer including the edge is formed with a material having a 100% modulus value (at 23° C.) within a range from 6 MPa to 12 MPa. This configuration can preferably abrade the projections formed on the surface of the image bearer by the charging member having the projections and recesses extending in the direction of rotation of the image bearer, as described in the first to third embodiments.

Accordingly, the cleaning capability can be reliable for a long time. Additionally, since the cleaning capability can be reliable to reduce the stain on the charging roller for a long time, image failure resulting from the stain on the charging roller can be inhibited, and the operation life can be longer.

Aspect E, in any of aspects B through D, the edge of the edge layer, or the side face that intersects the edge of the edge layer, slides on the projections formed on the surface of the image bearer, thereby abrading the projections. This configuration can preferably abrade the projections formed on the surface of the image bearer by the charging member having the projections and recesses extending in the direction of rotation of the image bearer, as described in the first to third embodiments.

Aspect F: In any of aspects B through E, the edge of the cleaning blade abuts against the projections on the surface of the image bearer. This configuration can preferably abrade the projections formed on the surface of the image bearer by the charging member having the projections and recesses extending in the direction of rotation of the image bearer, as described in the first to third embodiments.

Aspect G: In any of aspects A through F, DC voltage is applied to the charging member, thereby charging the image bearer. This configuration can reduce the load to the image bearer and reduce the amount of abrasion of the image bearer, thus extending the operational life, as described in the first through third embodiment.

Aspect H: In any of aspects A through G, the charging member is a charging roller, such as the charging roller 41 included in the charging device 40, and the charging device further includes a charging roller cleaner, such as the charging roller cleaner 42, to clean the surface of the charging roller. The charging roller cleaner is formed with a resin foam member having a continuous bubble structure such as melamine resin foam, and the bubble diameter of the resin foam member is smaller than the mean distance between the projections (or recesses) of the charging roller, in the direction of rotation of the image bearer.

As described in the second or third embodiment, this configuration can reduce the occurrence of image failure caused by toner additive and the like adhering to the surface of the charging roller, and the operational life of the charging device can be extended.

Additionally, since the surface of the charging roller includes the projections and the recesses extending in the circumferential direction, the surface area of the charging roller that contacts the image bearer can be reduced, and contact areas and gap areas can be reasonably distributed in the axial direction. Accordingly, the charging performance can be stable. Additionally, since the contact area is small, contamination of the image bearer by the charging roller and image failure due to the contamination of the charging roller can be inhibited.

Aspect I: In aspect H, the charging roller cleaner is formed with melamine resin foam and have a bubble diameter smaller than the mean distance between the projections (or recesses) of the charging roller by heat-compression molding. As described in the second or third embodiment, since melamine resin foam has relatively hard net-like fiber and can easily scrape off, or catch and peel, substances adhering to the surface of the charging roller. Accordingly, the capability of the charging roller cleaner to remove toner and toner additives adhering can increase.

Additionally, by making the bubble diameter smaller by heat-compression molding, the surface of the charging roller can be cleaned effectively, thus inhibiting image failure and extending the operational life of the charging device.

Aspect J: In any of aspects A through H, the image bearer includes a surface layer, such as the surface layer 93, that includes fine particles such as inorganic particles. As described in the third embodiment, the particles in the surface layer of the image bearer make the surface of the image bearer uneven, thus inhibiting filming of toner base and additives on the image bearer. Additionally, the charging member similarly includes the projections and recesses extending in the direction of rotation of the image bearer, and thus the contact area with the image bearer is smaller. Accordingly, the charging member does not press toner against the image bearer strongly.

This configuration can inhibit contamination of the image bearer by the charging member, filming on the image bearer, contamination of charging member by toner and the like on the image bearer. With the surface unevenness of the charging member, the contacts areas and the gap areas can be reasonably distributed in the axial direction, and the charging performance can be stable. Since the damage to the image bearer caused by electric discharge can become uniform, surface unevenness of the image bearer can be maintained even when the image bearer wears.

Aspect K: In a process cartridge that is removably installable in a body of the image forming apparatus and includes at least the image bearer, the charging member, and the cleaning member in a unified manner, the charging member and the cleaning blade according to one of aspects A through J are used. This configuration can facilitate installation and maintenance of those components. Further, incorporating the charging member and the cleaning member into a single modular unit can improve the positional accuracy thereof relative to the image bearer.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

a rotatable image bearer;

a charging member to contact a surface of the image bearer and charge the image bearer, the charging member having surface unevenness created by projections and recesses extending in a direction of rotation of the image bearer;

an exposure device to expose the image bearer and form a latent image, a developing device to develop the latent image on the image bearer into a toner image;

a transfer device to transfer the toner image from the image bearer onto a transfer medium; and a cleaning blade to contact the surface of the image bearer and remove toner from the image bearer after image transfer, the cleaning blade configured to abrade and remove a projection formed on the surface of the image bearer by the surface unevenness of the charging member, wherein the cleaning blade includes an edge layer that has a greater 100% modulus value and a greater JIS-A hardness than a 100% modulus value and a JIS-A hardness of a second layer of the cleaning blade.

2. The image forming apparatus according to claim 1, wherein the edge layer includes an edge to contact the image bearer.

3. The image forming apparatus according to claim 1, wherein the edge layer includes an edge to contact the image bearer, and the 100% modulus value of the edge layer at 23° C. is within a range from 6 MPa to 12 MPa.

4. The image forming apparatus according to claim wherein the edge layer includes an edge to contact the image bearer, and the cleaning blade is disposed such that either the edge of the edge layer or a face that intersects the edge abrades the projection on the surface of the image bearer by sliding on the projection.

5. The image forming apparatus according to claim 1, wherein the edge layer includes an edge to contact the image bearer, and the cleaning blade is disposed such that the edge of the edge layer contacts the projection on the surface of the image bearer.

6. The image forming apparatus according to claim 1, wherein DC voltage is applied to the charging member to charge the image bearer.

7. The image forming apparatus according to claim 1, wherein the charging member is a charging roller, the charging member further comprises a charging roller cleaner to clean a surface of the charging roller, the charging roller cleaner is formed with a resin foam member having a continuous bubble structure, and in the direction of rotation of the image bearer, the bubble diameter of the resin foam member is smaller than a mean distance between the projections in the surface of the charging roller.

8. The image forming apparatus according to claim 1, wherein the image bearer comprises a surface layer that includes fine particles.

9. The image forming apparatus according to claim 1, wherein the cleaning blade abrades and removes the projection making the surface of the image bearer smooth.

10. The image forming apparatus according to claim 1, wherein the 100% modulus value of the edge layer at 23° C. is within a range from 6 MPa to 12 MPa, and the 100% modulus value of the second layer at 23° C. is within a range from 4 MPa to 5 MPa.

11. The image forming apparatus according to claim 1, wherein the JIS-A hardness of the edge layer is 80 degrees, and the JIS-A hardness of the second layer is 75 degrees.

12. The image forming apparatus according to claim 7, wherein the resin foam member forming the charging roller cleaner comprises melamine resin foam, and the resin foam member is produced by heat-compression molding to have the bubble diameter smaller than the mean distance between the projections in the surface of the charging roller.

13. A process cartridge removably installable in a body of an image forming apparatus, the process cartridge comprising:

a rotatable image bearer;

a charging member to contact a surface of the image bearer and charge the image bearer, the charging member having surface unevenness created by projections and recesses extending in a direction of rotation of the image bearer; and a cleaning blade to contact the surface of the image bearer and remove toner from the image bearer after image transfer, the cleaning blade configured to abrade and remove a projection formed on the surface of the image bearer by the surface unevenness of the charging member, wherein the cleaning blade includes an edge layer that has a greater 100% modulus value and a greater JIS-A hardness than a 100% modulus value and a JIS-A hardness of a second layer of the cleaning blade.

* * * * *